United States Patent [19]

Miller

[11] 4,198,822

[45] Apr. 22, 1980

[54] LOAD RESPONSIVE HYDRAULIC SYSTEM

[75] Inventor: Wendell E. Miller, Warsaw, Ind.

[73] Assignee: The Scott & Fetzer Company, Lakewood, Ohio

[21] Appl. No.: 815,863

[22] Filed: Jul. 18, 1977

[51] Int. Cl.[2] ..... F15B 13/04; F15B 13/06

[52] U.S. Cl. ..... 60/445; 60/452; 91/6; 91/31; 137/596.13

[58] Field of Search ..... 91/6, 31; 137/596.13; 60/445, 452

[56] References Cited

U.S. PATENT DOCUMENTS

| | | | |
|---|---|---|---|
| 3,693,506 | 9/1972 | McMillen et al. | 137/115 |
| 3,847,180 | 11/1974 | Kroth et al. | 137/596.13 |
| 3,878,864 | 4/1975 | Schurger | 137/115 X |
| 3,902,401 | 9/1975 | Allen et al. | 91/6 |
| 3,971,216 | 7/1976 | Miller | 60/445 |
| 4,028,889 | 6/1977 | Budzich | 60/445 |

*Primary Examiner*—Irwin C. Cohen
*Attorney, Agent, or Firm*—Wendell E. Miller

[57] ABSTRACT

Each directional control valve of a load responsive hydraulic system supplies a flow of signal fluid to a work port channel thereof and pressurizes this flow of signal fluid to a predetermined pressure magnitude above the load actuating pressure in the work port channel to provide a synthetic signal pressure. Fluid logic is provided for the selection of the highest synthetic signal pressure from any of the directional control valves and for application of this highest synthetic signal pressure to an effective output operator for the control of the pressure and effective output of the pump.

54 Claims, 27 Drawing Figures

FIG. 8
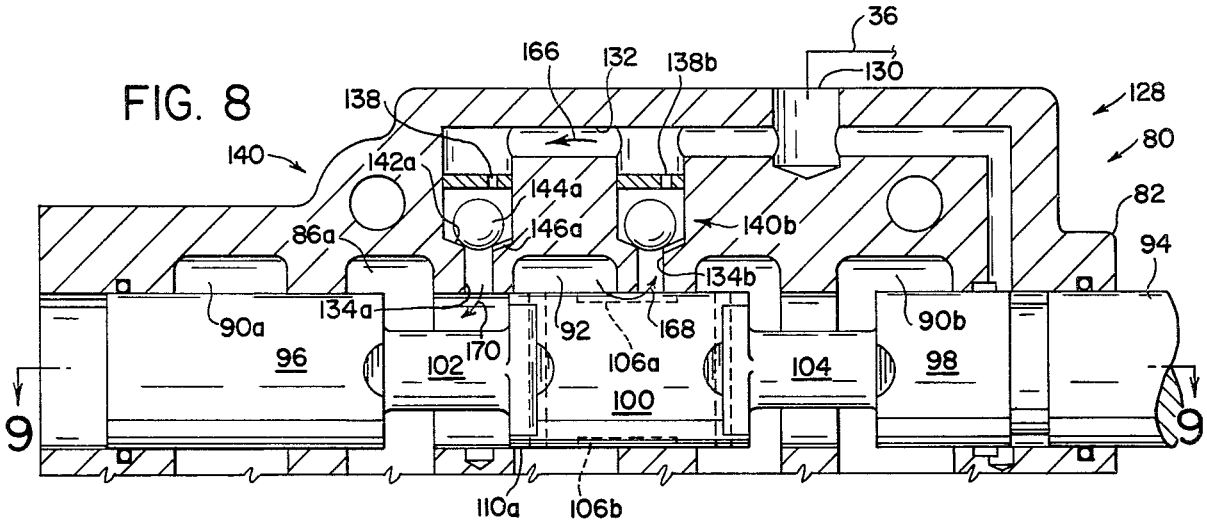
FIG. 9
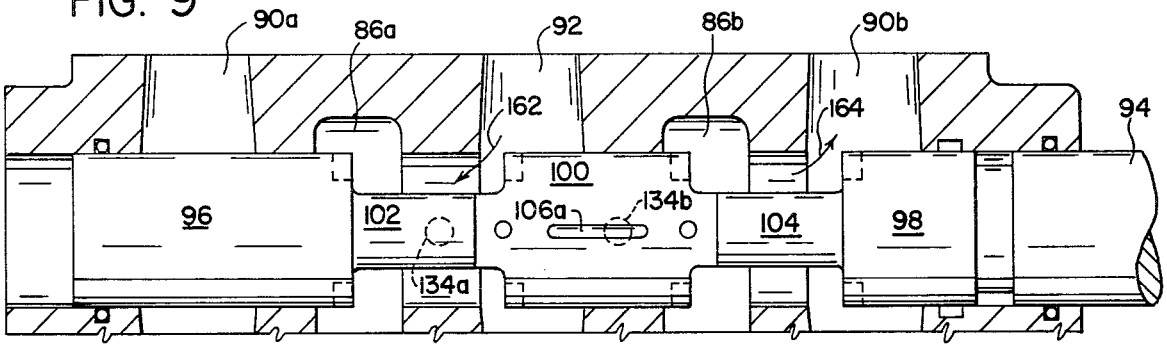
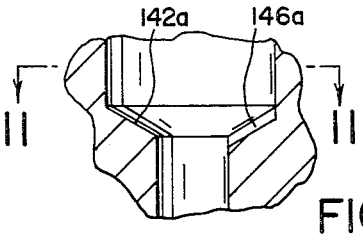
FIG. 10
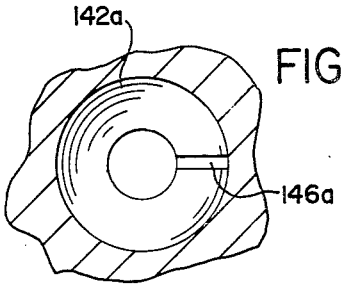
FIG. 11
FIG. 12
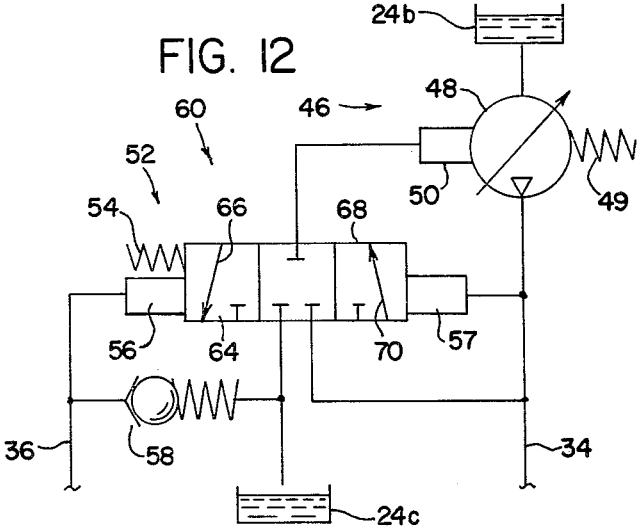

180
36
181a
179a
188
130a
138a
196
138b
182a
134a
134b

189
W1
X
P
P
X
W2
194
183
86a
198a
92
92
86b
198b
181b
179b
130b
190
166
167
182b
169
168
202b
202a
170
171

134a
134b

W1
X
P
P
X
W2
86a
198a
198b
86b
192

212b
218a
212a
218b
184
204a
206
210a
210b
185
205a
208a
208b
222
P
P
W1
214a
220b
214b
W2
216a
216b
24f 36
230a
232
130d
218c
242a
242b
244
W1 X X
P T P
X X W2 W2
240a
240b
240c
234
230b
218d
250
218e
204a
204b
208a
208b
P T T
T T P
W1
W2
252a
252b
252c
252d
216a
216b
228
224c
226c
227c
230c
236
130f
254a
254b
254c
P T T T
T T P
X X W2 W2
214c
199c
224d
230d
238
130g
256
274
271
270b
268
272
301
218h
218j
204a
305
270a
307
206
303
210a
319
309
311
210b
258a
258b
222
308a
P2 T T T
P2 T P1 T
308b
24g
W1
W2
262a
260a
264a
310a
260b
262b
264b
310b
216a
216b 280
238
256
288
300
24j
24h
284
282
286
292b
294b
296
298
294a
292a
290
206
222
308b
218j
130g
271
270b
270a
268
258b
258a
318
312c
342a
350
334
351
330
332
328
302
308a
218h
204a
304
299
297
306

280
238
256
288
284
282
286
292b
348
294b
296
314b
312c
346a
298
312b
346b
294a
272
268
270b
210b
130g
270a
274
319
210a
344
350
258b
258a
301
305
303
351
314a
218h
204a
205a 280
238
256
130g
218j
307
206
222
308b
309
311
210b
210a
302
204a
308a
304
297
300
306
354
332
328
336
288
312a
292a
290
294a
337
330
338b
338a
314a
334
322a
322b
314b
312b
258a
258b
320
318
324a
324b
352
314c
326a
326b
312c
298
296
312d
294b
314d
312e
292b
282
286
284

280
238
256
130g
206
222
210b
210a
204a
258a
258b
322a
318
322b
242a
340a
340b
316
298
296
294b
314d
292b
282
286
284
294a
314a
292a
328
288

LOAD RESPONSIVE HYDRAULIC SYSTEM

BACKGROUND OF THE INVENTION

1. Field of the Invention

The present invention generally relates to directional control valves of the type in which the load actuating pressure of a fluid motor is sensed by the directional control valve when the directional control valve is supplying pressurized fluid from a pressure inlet channel to a work port channel.

The present invention also generally relates to load responsive hydraulic systems of the type in which the pressure and the effective output of the pump are controlled to maintain the system pressure at a predetermined pressure magnitude above the highest load actuating pressure that exists in a plurality of directional control valves. The control of the pressure and effective output of a variable displacement pump is achieved by the control of the pump displacement; and the control of the pressure and the effective output of a fixed displacement pump is achieved by a by-pass valve that discharges excess pump flow to a sump.

The present invention more particularly relates to load responsive hydraulic systems of the type in which a flow of signal fluid is supplied from the pump and this flow of signal fluid is used to generate a synthetic signal pressure that is higher than the highest load actuating pressure that exists in a plurality of directional control valves.

The present invention specifically relates to load responsive hydraulic control valves in which each directional control valve furnishes a flow of signal fluid from the pressure inlet channel thereof to the work port channel thereof, and in which a synthetic signal pressure is generated in this flow path from the pressure inlet channel to the work port channel.

The present invention also specifically relates to load responsive hydraulic systems in which a plurality of directional control valves, each providing their own supply of signal fluid only when needed, are interconnected to form a load responsive hydraulic system in which the maximum flow capacity of each directional control valve is increased by the control of the pressure and effective output of the pump by the highest synthetic signal pressure, and in which all shock pressure problems relating to the flow of signal fluids are eliminated by the signal fluid being furnished to each directional control valve only when needed.

2. Description of the Prior Art

The use of a pump supplied fluid for the generation of synthetic signal pressure in load responsive hydraulic systems was disclosed in U.S. Pat. No. 3,971,216 of common inventor entity and common assignee. The synthetic signal pressure that is developed therein is a predetermined value above the highest load actuating pressure of any of the directional control valves that are supplying pressurized fluid to a fluid motor. By controlling the effective output of the pump by this synthetic signal pressure, the pressure differential across a directional control valve, from a pressure inlet channel to the work port channel, is increased and therefore the maximum flow capacity of the directional control valve is increased.

The above referenced load responsive hydraulic system, of the synthetic signal type, achieves the advantage of a low stand-by pressure for the minimization of power loss and heat rise during stand-by conditions and also achieves the additional advantage of a relatively high differential pressure, from a pressure inlet channel to a respective work port channel of any of the directional control valves, for achieving good flow capacity to the work port channels. However, the synthetic signal type of load responsive hydraulic system has the inherent disadvantage of producing pressure surges in the output pressure due to the flow of signal fluid and resultant timing problems in the individual directional control valve.

Schurger, in U.S. Pat. No. 3,878,864, disclosed a load responsive hydraulic system in which a signal fluid was supplied from the pump and a unique by-pass valve to the directional control valve only after the load actuating pressure from one of the control valves was supplied to the special and rather complex by-pass valve. The use of this by-pass valve was effective to start the flow of signal fluid only when needed and thus eliminated shock pressures which ordinarily would occur in a load responsive system of the synthetic signal type when a directional control valve is moved from a stand-by position to an operating position; but it was not effective to stop the flow of fluid before an unnecessarily high shock peak was developed when the directional control valve was moved from the operating position back to a stand-by position.

In this same patent, Schurger disclosed a load responsive control valve which, when used in conjunction with his specially designed by-pass valve, would eliminate the shock peak that ordinarily would be incurred when the valve spool of the directional control valve were moved from an operating position back to a stand-by position.

In U.S. Pat. No. 4,089,169 of common inventor entity and common assignee as that of the present invention, a load responsive hydraulic system is disclosed that includes a logic system that is effective to control the flow of signal fluid to the load responsive directional control valves only after an attenuation flow path in one of the directional control valves is occluded. This unique logic system is effective to solve, with less complexity and lower cost than the Schurger by-pass valve, the shock pressure peaks which are associated with moving a valve spool of the directional control valve from stand-by position to an operating position; and, when used in a load responsive system having directional control valves similar to those that are disclosed by Schurger, is effective to eliminate all shock pressure problems which are associated with load responsive hydraulic systems of the synthetic signal type.

In the FIG. 3 embodiment of U.S. Pat. No. 3,971,216, a directional control valve was disclosed in which the synthetic signal fluid is furnished from either of a pair of pressure inlet channels of a directional control valve to a control port of the directional control valve by a pair of valved flow paths. This FIG. 3 embodiment is similar to the present invention in that a valved signal path was provided; but it differs in that no provision was made to time the opening and the closing of these valved signal paths with the opening and closing of the fluid flow paths between the respective ones of the work port channels and the return channels.

SUMMARY OF THE INVENTION

The Basic Directional Control Valve

The basic directional control valve includes a valve body having a pressure inlet channel, first and second work port channels, and a return channel. A valve spool is slidably inserted into the valve body and is movable from a stand-by position to an operating position to establish a first fluid flow path from the pressure inlet channel to the first work port channel and to establish a second fluid flow path from the second work port channel to the return channel.

The directional control valve also includes cooperating portions of the valve spool and the valve body which are effective to establish a restricted flow path from the pressure inlet channel to the first work port channel after the second fluid flow path is established, thereby providing a limited flow of signal fluid from the pressure inlet channel to the first work port channel only after fluid can be exhausted from the second work port channel to the return channel by the fluid motor. In other words, the flow of signal fluid is supplied only when this flow of signal fluid can actuate the fluid motor by fluid flow into one port thereof with resultant exhaust flow out of the other port thereof.

In a preferred embodiment, a second fluid restrictor is placed into the restricted flow path and the pressure intermediate of the two restrictions, which is at a predetermined pressure magnitude above the load actuating pressure of the fluid motor and which is called the synthetic signal pressure, is sensed for application to an effective output operator that controls the pressure and effective output of a hydraulic pump.

Optional Valve Configurations

In several optional configurations of the present invention, the flow of signal fluid which is supplied by the directional control valve flows through a check valve or other one-way flow means directly to a work port channel of the directional control valve rather than being controlled by the valve spool. In these optional configurations, the valved signal principle and function of the present invention may be adapted to directional control valves which include flow control devices intermediate of the valve spool and the work port thereof, such as the copending application of common inventor entity, common assignee, and common filing date.

Logic System for the Interconnection of Directional Control Valves

All of the embodiments for the directional control valves for the present invention may be interconnected by the use of series connected three-port logic valves such as are fully shown and described in U.S. Pat. No. 3,971,216; or because of the change in the direction in the flow of signal fluid in the present invention from that of the synthetic signal system in U.S. Pat. No. 3,971,216, a simpler and lower cost logic system, which comprises parallel connected check valves, may be used.

OBJECTS OF THE INVENTION

It is a first object of the present invention to provide a load responsive hydraulic system of the synthetic signal type in which shock pressures are minimized during the actuating of the directional control valve from a stand-by position to an operating position.

It is a second object of the present invention to provide a load responsive hydraulic system of the synthetic signal type in which shock pressures are minimized during the actuating of the directional control valve from the operating position to the stand-by position.

It is a third object of the present invention to provide a load responsive hydraulic system in which signal fluid is furnished to each directional control valve only when needed.

It is a fourth object of the present invention to provide a load responsive hydraulic system in which signal fluid is furnished to each directional control valve from the pressure inlet channel thereof.

It is a fifth object of the present invention to provide a restricted flow path from the pressure inlet channel to the work port channel when the pressure inlet channel is communicated to the work port channel for the supply of pressurized fluid to a fluid motor.

It is a sixth object of the present invention to provide a directional control valve in which a restricted flow path is established from the pressure inlet channel to the first work port channel after a fluid flow path has been established from the second work port channel to the return port channel.

It is a seventh object of the present invention to provide a directional control valve in which a signal flow path, having first and second fluid restrictors connected in series therein, is established from the pressure inlet channel to the work port channel of the directional control valve when a fluid flow path is established from the pressure inlet channel to the work port channel for the supplying of pressurized fluid to a fluid actuated device, and in which a synthetic signal pressure is sensed intermediate of the series-connected restrictor.

It is an eighth object of the present invention to provide a directional control valve in which a signal flow path, having first and second series-connected fluid restrictors therein, is established from the pressure inlet channel to the first work port channel after a fluid flow path has been established from a second work port channel to a return port channel, and in which a synthetic signal pressure is sensed intermediate of the series-connected restrictors.

It is a ninth object of the present invention to provide a directional control valve which includes a valved flow path portion from the pressure inlet channel to a control port thereof.

It is a tenth object of the present invention to provide a directional control valve which includes a first valved flow path portion from the pressure inlet channel to a control port and a second valved flow path portion from the control port to the work port channel.

It is an eleventh object of the present invention to provide a directional control valve which includes a valved flow path portion from the pressure inlet channel to a control port and which includes one-way flow means from the control port to a work port channel.

It is a twelfth object of the present invention to provide a load responsive hydraulic system in which the logic system thereof includes series-connected three-port logic valves that interconnect the synthetic signal pressures of the individual directional control valves and that select the highest synthetic signal pressure therefrom for control of the pressure and effective output of the pump.

It is a thirteenth object of the present invention to provide a load responsive hydraulic system in which the logic system thereof includes parallel-connected check valves that interconnect the synthetic signal pressures of the individual directional control valves and that select the highest synthetic signal pressure therefrom for control of the pressure and effective output of the pump.

These and other objects will be apparent to the reader from the detailed description.

BRIEF DESCRIPTION OF THE DRAWINGS

FIG. 8 is a partial cross-sectional view of the directional control valve of FIG. 1, taken substantially as shown in FIG. 1 but with the valve spool thereof moved to an operating position;

FIG. 9 is a partial cross-sectional view of the directional control valve of FIG. 8, taken substantially as shown by section line 9—9 of FIG. 8;

FIG. 10 is a partial cross-sectional view of the directional control valve of FIG. 1, showing a detail thereof in an enlarged scale;

FIG. 11 is a partial cross-sectional view of the directional control valve of FIG. 1 taken substantially as shown by section line 11—11 of FIG. 10;

FIG. 12 is a schematic drawing of typical system components which may be used with any of the directional control valves of the present invention and which may be used alternately with the system components of FIG. 3;

DETAILED DESCRIPTION

The Fixed Displacement Pump System

Figure 3:
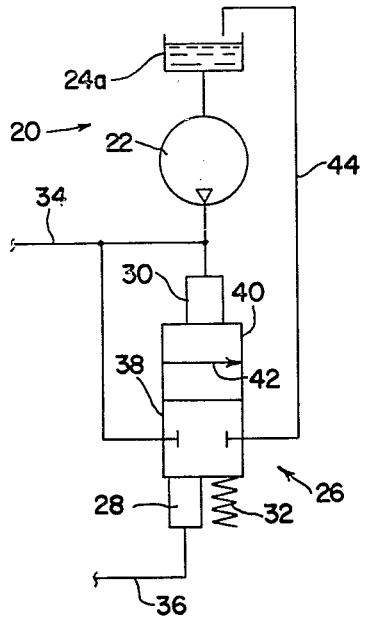
FIG. 3 is a schematic drawing of typical hydraulic system components which may be used with any of the directional control valves of the present invention.

Referring now to FIG. 3, a typical schematic circuit and typical components thereof are shown for utilizing a directional control valve of the present invention in a load responsive hydraulic system which includes a fixed displacement pump. The circuitry of FIG. 3 includes a source of pressurized fluid 20 which comprises a pump 22 and a sump **24*a*, an effective output means or by-pass valve 26 which includes an effective output operator 28, another operator 30, and a spring 32**.

In operation, the pump 22 delivers pressurized fluid to a pump pressure conduit 34 for use by one or more directional control valves of the present invention which will be subsequently described, and a signal pressure, which may be either the highest load actuating pressure or synthetic signal pressure from these control valves, is supplied to a signal conduit 36 and to the effective output operator 28. The operators 28 and 30 have equal areas; and the by-pass valve 26 is moved to a position 38, as shown, when a force that is developed by the signal pressure in the effective output operator 28, plus the force of the spring 32, is greater than the force developed by the pump output pressure in the operator 30; and the by-pass valve 26 is moved to a position 40 wherein a flow path 42 by-passes excess fluid from the pump 22 to the sump **24*a* via a conduit 44 when the force of the operator 30 exceeds the combined forces of the operator 28 and the spring 32. Thus the by-pass valve 26 is effective to control the pressure and the effective output of the pump 22 to maintain a pump pressure in the conduit 34 which exceeds the signal pressure in the signal conduit 36 by a value which is in accordance with the effective area of the operator 30 divided by the force of the spring 32**.

The Variable Displacement Pump System

Referring now to FIG. 12, the variable displacement pump system of FIG. 12 includes a source of pressurized fluid 46 having a variable displacement pump 48 and having a sump **24*b*, a displacement control pilot valve 52 that includes a spring 54 and that also includes both an effective output operator 56 and another operator 57, a pilot relief valve 58, and a sump 24c. The pump 48 includes a displacement control operator 50 which is effective to decrease the displacement of the pump 48 in response to fluid pressure supplied to the operator 50, and a spring 49 which is effective to incresse the displacement of the pump 48 in the absence of a spring overcoming force from the displacement control operator 50**.

Thus the system of FIG. 12 includes effective output means 60 which comprises both the displacement control operator 50 of the variable displacement pump 48 and the displacement control pilot valve 52 with the effective output operator 56 thereof.

In operation, either the load actuating pressure of a directional control valve or a synthetic signal pressure from a directional control valve, is applied to a signal conduit 36. When the signal pressure of the signal conduit 36 creates a fluid force in the effective output operator 56 which, together with the force of the spring 54, is effective to overcome the pressure of the pump 48 in the operator 57, then the pilot valve 52 is moved to a position 64 wherein a flow path 66 communicates the displacement control operator 50 with the sump 24c allowing the spring 49 of the pump 48 to actuate the pump 48 to a higher displacement by exhausting fluid from the displacement control operator 50 to the sump 24c via the flow path 66.

When the pump pressure in the operator 57 is effective to overcome the combined force of the effective output operator 56 and the spring 54, the pilot valve 52 is actuated to a position 68 wherein a flow path 70 adds pressurized fluid to the displacement control operator 50 from the pump pressure conduit 34; and the displacement control operator 50 reduces the displacement of the pump 48 in opposition to the force of the spring 49.

The pilot relief valve 58 is effective to limit the maximum fluid pressure in the signal conduit 36; so that the maximum output pressure of the pump 48 is a function of the pressure setting of the pilot relief valve 58 and the load of the spring 54. This use of a pilot relief valve is standard in the art for controlling the maximum operating pressure of variable displacement pumps, such as the pump 48, and for controlling the maximum operating pressure of fixed displacement pumps, such as the pump 22 of the FIG. 3 system embodiment.

A First Preferred Valve Embodiment

Figures 1, 1A, 2:
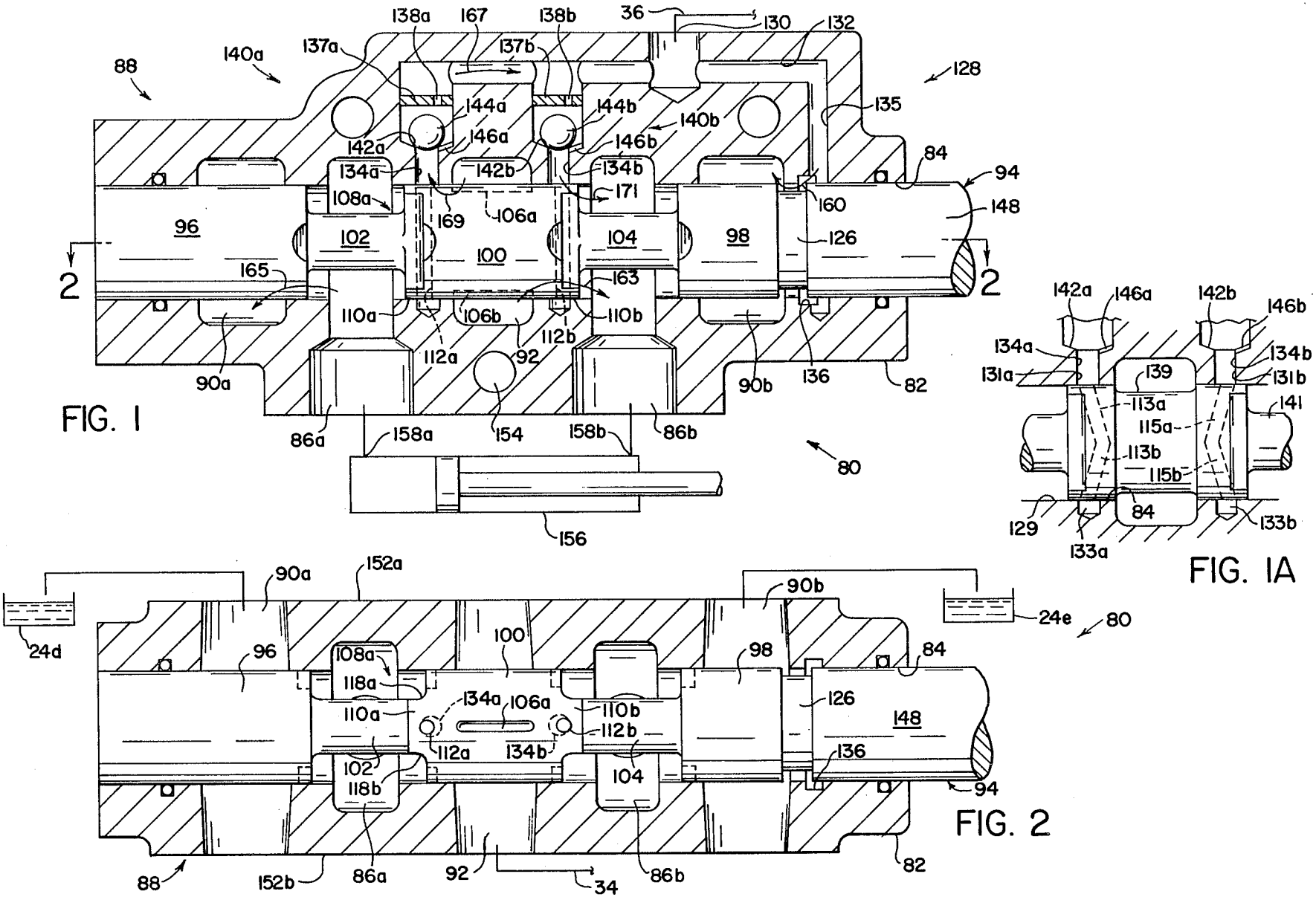
FIG. 1 is a cross-sectional drawing of a first preferred embodiment of a directional control valve of the present invention, with the valve spool thereof in the stand-by position.
FIG. 1A is a partial and phantom cross-sectional view showing a valve spool modification of the directional control valve of FIG. 1.
FIG. 2 is a cross-sectional drawing of the directional control valve of FIG. 1 taken substantially as shown by cross-section line 2—2 of FIG. 1.

Referring now to FIGS. 1 and 2, a directional control valve 80 includes a valve body 82 having a spool bore 84, having first and second work port channels 86 and 86b, having a return port means 88 that includes a first return channel 90a and a second return channel 90b, and having a pressure inlet channel 92. A valve spool or movable valving element 94 is slidably inserted into the spool bore 84 and is positionable to a stand-by position as shown in FIGS. 1 and 2 and to an operating position as shown in FIGS. 8 and 9.

Figure 4:
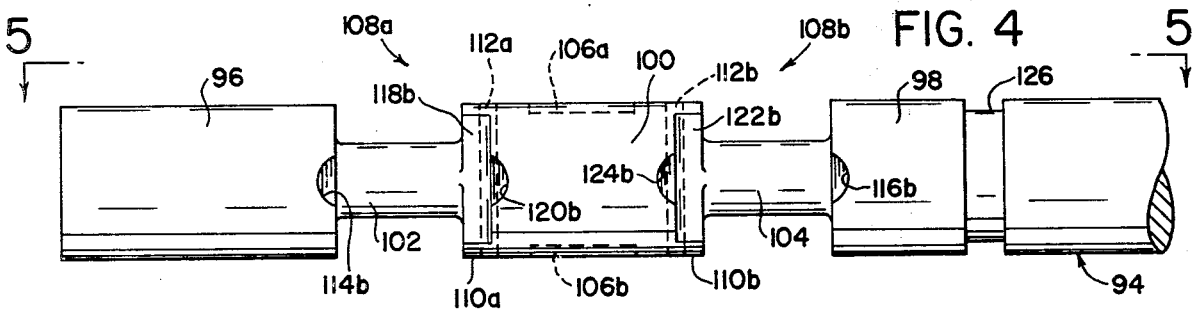
FIG. 4 is a front view of the valve spool of the directional control valve of FIG. 1, taken substantially as shown in FIG. 1.
Figure 5:
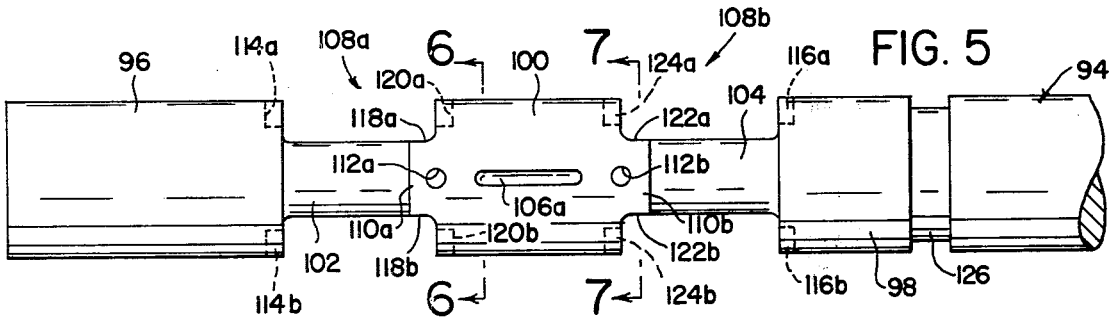
FIG. 5 is a top view of the valve spool of FIG. 4 taken substantially as shown by view line 5—5 of FIG. 4.
Figure 6:
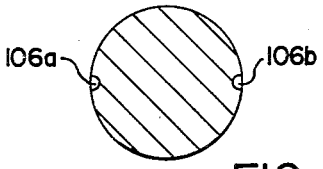
FIG. 6 is a cross-sectional view of the valve spool of FIG. 5 taken substantially as shown by section line 6—6 of FIG. 5.

Referring now to FIGS. 4 and 5, the valve spool 94 includes a first land portion 96, a second land portion 98, a center land portion 100, a first reduced cross-section portion 102, a second reduced cross-section portion 104, diametrically opposed and longitudinally extending grooves 106a and 106b in the center land portion 100, tang and notch means 108a and tang and notch means 108b that are disposed on opposite ends of the center land portion 100 and that include longitudinally extending tangs 110a and 110b, radial balancing holes 112a and 112b that are generally disposed in respective ones of the tangs 110a and 110b, outlet metering notches 114a and 114b and outlet metering notches 116a and 116b.

Tang and notch means 108a comprises diametrically opposed tang notches 118a and 118b and metering notches 120a and 120b; and, in like manner, tang and notch means 108b comprises diametrically opposed tang notches 122a and 122b and metering notches 124a and 124b. The valve spool 94 also includes circumferential groove 126.

Referring now to FIGS. 1, 1A, and 2, the directional control valve 80 includes valved signal means 128 which comprises a control port 130, a connecting passage 132 that communicates with the control port 130, a first signal passage 134a and a second signal passage 134b that both communicate with the connecting passage 132, signal or attenuation passage 135, bore groove 136, orifice plates 137a and 137b which respectively include fixed conductance restrictors 138a and 138b, one-way flow and reverse flow restrictor valves 140a and 140b which respectively include seats 142a and 142b and balls 144a and 144b, seat grooves or fixed conductance restrictors 146a and 146b, and cooperating portions of the valve spool 94.

The cooperating portions of the valve spool 94 which are included in the valved signal means 128 include the center land portion 100, tangs 110a and 110b of the center land portion 100, longitudinally extending grooves 106a and 106b of the center land portion 100, the reduced cross-section portions 102 and 104, the second land portion 98, the circumferential groove 126, and another land portion 148.

Figure 7:
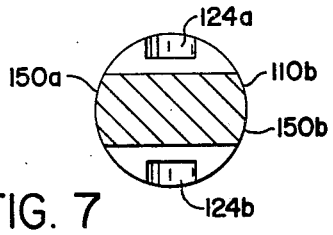
FIG. 7 is a cross-sectional view of the valve spool of FIG. 5, taken substantially as shown by section line 7—7 of FIG. 5.

Referring now to FIGS. 4 to 7, FIG. 6 shows the substantially constant cross-sectional areas of the longitudinally extending grooves 106a and 106b; and FIG. 7 shows a cross-sectional area of the center land portion 100 through the tang 110b thereof and also shows an end view of the metering notches 124a and 124b. As shown in FIG. 7, the tang 110b includes cylindrical surface portions 150a and 150b.

Referring now to FIGS. 10 and 11, FIG. 10 shows an enlarged portion of FIG. 1, taken substantially as shown in FIG. 1, and depicting the seat 142a and the seat groove or fixed conductance restrictor 146; and FIG. 11 shows a top view of the seat 142a and the restrictor 146a. The seat 142b and the fixed conductance restrictor 146b are the same as the seat 142a and groove 146a of FIGS. 10 and 11.

Referring now to FIGS. 1 to 3, the directional control valve 80 is typical of one of a number of working sections of a sectional type directional control valve which may be bolted together at faces 152a and 152b by a plurality of bolts (not shown) which are inserted through a plurality of holes 154. Each working section, such as the directional control valve 80, may then be connected to a fluid actuated device such as the fluid actuated device 156 which is connected to the work port channels 86a and 86b by actuating ports 158a and 158b respectively. The pump pressure conduit 34 of the FIG. 3 illustration is then connected to the like numbered conduit of FIG. 2 to supply pressurized fluid to the pressure inlet channel 92 of the directional control valve 80 and to any other working sections that may be included.

In stand-by operation, with the valve spool 94 in the stand-by position as shown, the pressure inlet channel 92 is isolated from the work port channels 86a and 86b; and the work port channels 86a and 86b are isolated from the return port means 88 which includes the return channels 90a and 90b. Also, at this time, the signal passages 134a and 134b are isolated from both the pressure inlet channel 92 and from respective ones of the work port channels 86a and 86b by the center land portion 100; so the load actuating pressures in the work port channels 86a and 86b are not sensed by the control port 130.

Instead, at this time, the control port 130 is communicated to the return channel 90b by the signal or attenuation passage 135 and the bore groove 136 which cooperate with the circumferential groove 126 to provide a fluid flow path or attenuation flow path 160 from the control port 130 to the second return channel 90b. The attenuation flow path 160 is effective to attenuate or reduce the signal pressure in the signal conduit 36 to the value of the pressure in a sump 24e; so that a very low pressure of the pump 22 in the operator 30 is effective to overcome the spring 32, thereby moving the by-pass valve 26 to the position 40 and by-passing all of the fluid of the pump 22 to the sump 24a via the flow path 42.

Referring now to FIGS. 1–3 and 8–9, the valve spool 94 of FIGS. 8 and 9 has been moved to an operating position wherein a first fluid flow path 162 has been established from the pressure inlet channel 92 to the first work port channel 86a; and wherein a second fluid flow path 164 has been established from the second work port channel 86b to the second return channel 90b; so that pressurized fluid is supplied from the pump 22 of FIG. 3 to the fluid actuated device 156 of FIG. 1 via the first actuating port 158a, and fluid is exhausted from the fluid actuated device 156 through the second actuating port 158b.

At this time, a third fluid path or restricted flow path 166 is established from the pressure inlet channel 92 to the first work port channel 86a. The restricted flow path 166 includes a valved or restricted flow path portion 168 and a valved or restricted flow path portion 170 that are interconnected by the connecting passage 132. The valved or restricted flow path portion 168 includes the grooves 106a and 106b, signal passage 134b, and the restrictor 138b in the signal passage 134b. The valved or restriced flow path portion 170 includes the signal passage 134a, the restrictor 138a in the signal passage 134a, and the groove or restrictor 146a in the signal passage 134a. The valved or restricted flow path portion 170 is valved by the interaction of the tang 110a and the reduced cross-section portion 102 with the signal passage 134a; and the valved or restricted flow path portion 168 is valved by interaction of the center land portion 100 and the grooves 106a and 106b thereof with the signal passage 134b.

With the pressure inlet channel 92 of the directional control valve 80 being connected to the pump 22 by the pump pressure conduit 34, and with the valve spool 94 being in the operating position as shown in FIGS. 8 and 9, a supply of signal fluid is furnished from the pressure inlet channel 92 to the first work port channel 86a by the third fluid flow path 166. This flow of signal fluid flows through the fixed conductance restrictor 138b to reach the connecting passage 132 and then through the series-connected restrictors 138a and 146a to reach the first work port channel 86a. Thus this signal fluid flows through a single fluid restrictor 138b to reach the connecting passage 132 and through two series-connected restrictors, 138a and 146a, to flow from the connecting passage 132 to the work port channel 86a.

If all three of the restrictors in the third fluid flow path 166 have the same conductance, then not only is the flow through each of these fluid restrictors at the same flow rate, but also the pressure drop across each fluid restrictor will be the same. Therefore, the fluid pressure in the connecting passage 132, and thus in the control port 130 will be less than the fluid pressure in pressure inlet channel 92 by one-third of the difference between the fluid pressures in pressure inlet channel 92 and the first work port channel 86a. Also, the pressure differential between the pressure inlet channel 92 and the control port 130 will correspond to the area of the operator 30 of the by-pass valve 26 divided by the spring load of the spring 32.

The result of the combination thus described is that the pump operating pressure will be maintained at a first predetermined pressure magnitude above the fluid pressure in the signal conduit 36 and in the control port 130 by virtue of the spring 32; and the pressure magnitude of the pump 22 will be maintained at two additional and equal pressure magnitudes above the pressure magnitude of the load actuating pressure in the work port channel 86a by virtue of the pressure differentials across both the fixed conductance restrictor 138a and the fixed conductance restrictor 146a.

Or, in other words, during stand-by conditions, the pressure of the pump 22 will be maintained at a pressure differential above the fluid pressure in the sump 24d in accordance with the force magnitude of the spring 32; and when the valve spool 94 is in the operating position as shown in FIGS. 8 and 9, the pressure of the pump 22 will be maintained at a pressure magnitude above the load actuating pressure in the work port channel 86a which is three times the quotient of the area of operator 30 divided by the force of the spring 32. This higher pressure differential between the pump 22 and the load actuating pressure in the work port channel 86a is effective to increase the flow capacity of the directional control valve 80 by 73% by tripling the pressure differential from the pressure inlet channel 92 to the first work port channel 86a via the first fluid flow path 162.

In order to avoid shock pressure surges, which would be caused by blocking the flow of signal fluid and thereby allowing the pressure magnitude of the signal pressure to equal that of the pressure inlet channel 92, the second fluid flow path 164 must be opened before the third fluid flow path 166 is established; and the third fluid flow path 166 must be occluded before the second fluid flow path 164 is occluded.

If the third fluid flow path 166 is considered to include both the flow path portion 168 which includes and is valved by the longitudinally extending grooves 106a and 106b and the flow path portion 170 which includes and is valved by interaction of the first signal passage 134a and the tang 110a, then the flow path portion 170 must be opened before the flow path portion 168 is opened and the flow path portion 168 must be closed before the flow path portion 170 is closed.

In addition, the attenuation flow path 160 must be closed before the flow path portion 170 is opened or pressurized fluid will be lost from the first work port channel 86a to the sump 24d; and the attenuation flow path 160 must also be closed before the flow path portion 168 is opened or pressurized fluid will be lost from the pressure inlet channel 92 to the sump 24e.

The timing of the opening of the first fluid flow path 162 with respect to the opening of the flow path portions 168 and 170 is not particularly important; except that, it is preferable to open the flow path portions 168 and 170 before opening the first fluid flow path 162 so that the pressure of the pump 22 is adjusted in accordance with the load actuating pressure in the first work port channel 86*a* before the fluid flow path 162 is established, and thereby any delay in system response is avoided.

Referring again to FIGS. 1–2 and 8–9, the timing of the valve spool 94 with respect to the various channels in the valve body 82 preferably provides the following sequence of fluid communications and occlusions as the valve spool 94 is moved from the stand-by position in FIGS. 1 and 2 to the first operating position of FIGS. 8 and 9: occlusion of the attenuation flow path 160 and establishing of the second fluid flow path 164 from the second work port channel 86*b* to the return channel 90*b*, opening the flow path portion 170 from the control port 130 and the connecting passage 132 to the first work port channel 86*a*, opening the flow path portion 168 from the pressure inlet channel 92 to the control port 130 and to the connecting passage 132, and opening the first fluid flow path 162 from the pressure inlet channel 92 to the first work port channel 86*a*.

As the valve spool 94 is actuated from the operating position of FIGS. 8 and 9 to the stand-by position of FIGS. 1 and 2, the sequence of occluding and establishing fluid flow paths will be the opposite of that which has been recited above for actuating of the valve spool 94 from the stand-by position to the operating position. The actual distance of movement of the valve spool which is required between each establishing and occluding of each flow path will be in accordance with the manufacturing accuracy which can be maintained; and the illustrations of FIGS. 1 and 2 and of FIGS. 8 and 9 are drawn to approximate the aforementioned timing relationships.

Referring again to FIGS. 1, 2, 8, and 9, if the valve spool 94 is moved to the left of the stand-by position of FIGS. 1 and 2 to a second operating position, in like manner as the valve spool 94 is moved to the right in FIGS. 8 and 9 to a first operating position, then a fluid flow path 163 will be established from the pressure inlet channel 92 to the work port channel 86*b*, another fluid flow path 165 will be established from the work port channel 86*a* to the return channel 90*a* and to a sump 24*e*, and another fluid flow path or restricted flow path 167 will be established from the pressure inlet channel 92 to the work port channel 86*b*.

The restricted flow path 167 will include the valved or restricted flow path portions 169 and 171 which are interconnected by the passage 132. The flow path portion 169 will be valved by the longitudinal grooves 106*a* and 106*b* and will include the signal passage 134*a* and the restrictor 138*a* therein; and the flow path portion 171 will be valved by both the tang 110*b* and the reduced cross-section portion 104 and will include the signal passages 134*b* and the restrictors 138*b* and 146*b*.

Thus, in the second operating position, one-way flow and reverse flow restrictor valve 140*a* provides free flow from the longitudinal grooves 106*a* and 106*b* to the restrictor 138*a*, and the one-way flow and reverse flow restrictor valve 140*b* provides a fluid restriction intermediate of the restrictor 138*b* and the work port channel 86*b*.

System with Parallel Logic

Referring now to FIGS. 13A–13D, parallel logic 180, which includes check valves 182*a* and 182*b* and which also includes attenuation flow path 184, is used to interconnect valved signal means 188, 190, and 192.

The check valves 182*a* and 182*b* include respectively flow inlet ports 179*a* and 179*b* and flow outlet ports 181*a* and 181*b*. Any point of connection, such as a point 183 to a conduit 189 that interconnects the flow outlet ports 181*a* and 181*b* may be considered as a third logic port of the parallel logic 180, and the flow inlet ports 179*a* and 179*b* may be considered as first and second logic ports, respectively, of the parallel logic 180.

The check valves 182*a* and 182*b* are effective to select the higher signal pressure from either of the valved signal means, 188 or 190; because each signal means, 188 or 190, receives its own flow or supply of signal fluid from a pressure inlet channel thereof, as represented by a box 198*a* or 198*b*, and generates a signal pressure in a control port 130*a* or 130*b* thereof; and so the higher fluid pressure will be transmitted from a control port, 130*a* and 130*b*, to the signal conduit 36 by one of the check valves, 182*a* and 182*b*.

When the higher signal pressure is decreased, the fluid pressure in the signal conduit 36 is decreased by the attenuation flow path 184, which includes a restrictor 185, to a sump 24*f*.

In contrast, the highest signal pressure of the load responsive system of U.S. Pat. No. 3,971,216 cannot be selected by a logic system of parallel-connected check valves because the flow of signal fluid is from the pump to the directional control valves and to the work port channels thereof via the signal conduit.

Valved Signal Means for Parallel Logic

Figures 13A, 13B, 13C, 13D:
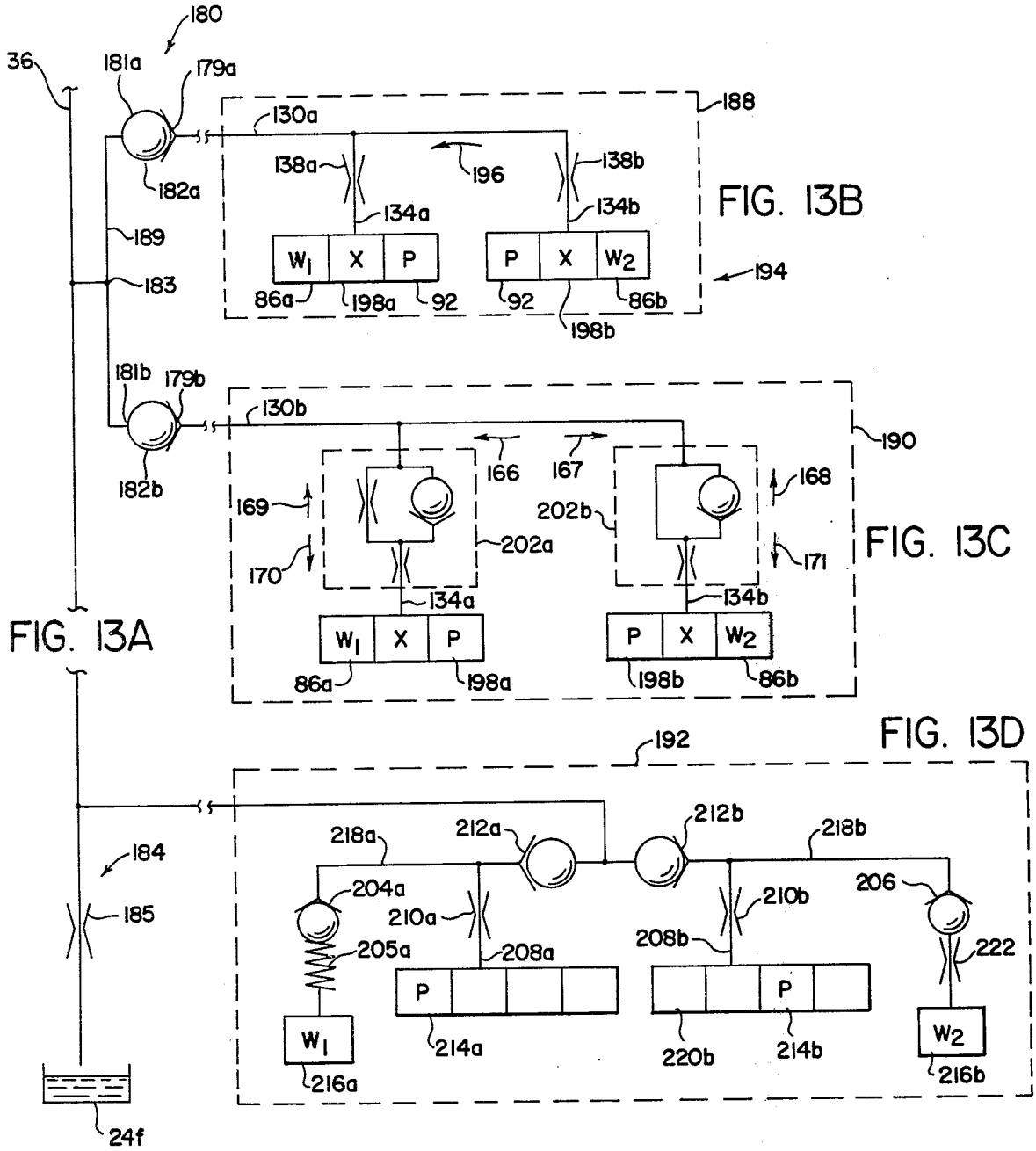
FIG. 13A is a schematic drawing of parallel-connected logic for interconnecting the valved signal means of FIGS. 13B–13C.
FIG. 13B is a schematic drawing for a valved signal means of a directional control valve, being adapted for use with the parallel-connected logic of FIG. 13A.
FIG. 13C is a schematic drawing of a different valved signal means for use with the logic of FIG. 13A.
FIG. 13D is a schematic drawing of a third variation of a valved signal means.

Referring now to FIGS. 1, 8, and 13B, the valved signal means 188 of FIG. 13B corresponds to valved signal means 128 of FIG. 1 except that the valved signal means 128 of FIG. 1 includes the attenuation flow path 160 whereas the valved signal means 188 of FIG. 13B includes only the valved signal means functions of communicating the signal passages 134*a* and 134*b* with the pressure inlet channel, as represented by the boxes 198*a* and 198*b*, and with respective ones of the first work port channels 86*a* and 86*b*. That is, when the valve spool 94 of the FIG. 1 embodiment is moved to the operating position of FIG. 8, the first signal passage 134*a* is communicated to the first work port channel 86*a*; and the second signal passage 134*b* is communicated to the pressure inlet channel 92.

In like manner, if the movement of the valve spool 94 of FIGS. 1 and 8 is considered to move rectangular boxes 194 of the FIG. 13B schematic illustration, then the same communications are made by valved signal means 188 of the FIG. 13B embodiment as are made by the valved signal means 128 of FIGS. 1 and 8 except for the elimination of the attenuation flow path 160 in the FIG. 13B embodiment. However, the fluid flow through a third fluid flow path 196 of the valved signal means 188 is simplified from that of the FIG. 1 embodiment since the third fluid flow path 196 includes only fixed conductance restrictors 138*b* and 138*a* whereas the third fluid flow path 166 of FIG. 8 also includes the restrictor 146*a* of the one-way flow and reverse flow restrictor valves 140*a*.

Referring now to FIGS. 13B–13D and 14B–14E, a letter X in a box, such as a box 195*a* of FIG. 13B, indicates that fluid communication is occluded; whereas the absence of any letter in such a box indicates the option of occluding fluid communication or establishing fluid communication with a sump.

Referring now to FIG. 13C, the valved signal means 190 illustrates a portion of a directional control valve which is even more similar to that of FIG. 1 than is the valved signal means 188 of FIG. 13B, in that, a third fluid flow path 166 of the valved signal means 190 includes one-way flow and reverse flow restrictor valves 202*a* and 202*b* which symbolically correspond to the one-way flow and reverse flow restrictor valves 140*a* and 140*b* of FIG. 1 and which are inserted into respective ones of signal passages 134*a* and 134*b*.

In like manner as the valved signal means 128 of FIGS. 1 and 8, the valved signal means 190 includes valved or restricted flow path portions 168 and 170 in the third fluid flow path 166. The valved signal means 190 also includes valved or restricted flow path portions 169 and 171 in a fluid flow path 167 when the pressure inlet channel of the box 198*a* is communicated to the work port channel 86*b* via the signal passages 134*a* and 134*b*.

Referring now to FIG. 13D, the valved signal means 192 includes a reverse fluid flow preventing means or one-way flow means which comprises a resiliently biased fluid restrictor or relief valve 204*a* and a reverse fluid flow restricting or preventing means which comprises a check valve 206. The valved signal means 192 also includes signal passages 208*a* and 208*b* having fixed conductance fluid restrictors 210*a* and 210*b* therein and check valves 212*a* and 212*b*.

In operation, the valved signal means 192 of FIG. 13D communicates a pressure inlet channel, as symbolized by a box 214*a*, to a first work port channel 216*a* when the valve spool (not shown) of the directional control valve (not shown) thereof is in one operating position. In this one operating position, pressurized fluid from the pressure inlet channel of the box 214*a* flows through the restrictor 210*a* and from thence through the relief valve 204*a* to the first work port channel 216*a*; so that a flow of signal fluid is furnished from the pressure inlet channel of the box 214*a* and is pressurized above the load actuating pressure of the fluid pressure in the first work port channel 216*a* by flow across the relief valve 204*a*.

This signal pressure, when increased above the load actuating pressure in the first work port channel 216*a* by the relief valve 204*a* is called the synthetic signal pressure. This synthetic signal pressure in a conduit 218*a* is supplied to the signal conduit 36 by way of the check valve 212*a*. At this same time, the signal passage 208*b* may be communicated to a sump (not shown), or the signal passage 208*b* may be blocked from communication with any fluid passage. This alternate communication with a sump or this blocking of the second signal passage 208*b* is symbolized in the valved signal means 192 by omission of any letter or symbol in a box 220*b*.

When the control valve (not shown) having the valved signal means 192 of FIG. 13D therein is actuated to another operating position, the second signal passage 208*b* is communicated to the pressure inlet channel, as symbolized by the box 214*b*, and a supply of signal fluid from the pressure inlet channel of the box 214*b* is delivered to a second work port channel 216*b* through the restrictor 210*b*, and then through both a check valve 206 and a fixed conductance restrictor 222.

Thus the reverse flow preventing means or relief valve 204*a* functions both to prevent reverse flow and to add a predetermined pressure magnitude to the fluid pressure in the conduit 218*a* over that in the first work port channel 216*a*; whereas both the reverse flow preventing means or check valve 206 and the fixed conductance restrictor 222 are required to prevent reverse flow and to add a predetermined pressure differential to the fluid flowing from a conduit 218*b* to the second work port channel 216*b*.

Referring again to FIG. 14E, it is well-known in the art that one-way flow, or check valves, may or may not include springs, such as a spring 205*a* of the reverse flow preventing means 204*a*. For purposes of description herein, a relief valve includes a spring having a pressure differential effect on fluid flow that is substantially equal to or greater than the fluid pressure effect of the spring 32 of the by-pass valve 26 of FIG. 3, or of the spring 54 of the pilot valve 52 of FIG. 12.

Figures 14A, 14B, 14C, 14D, 14E:
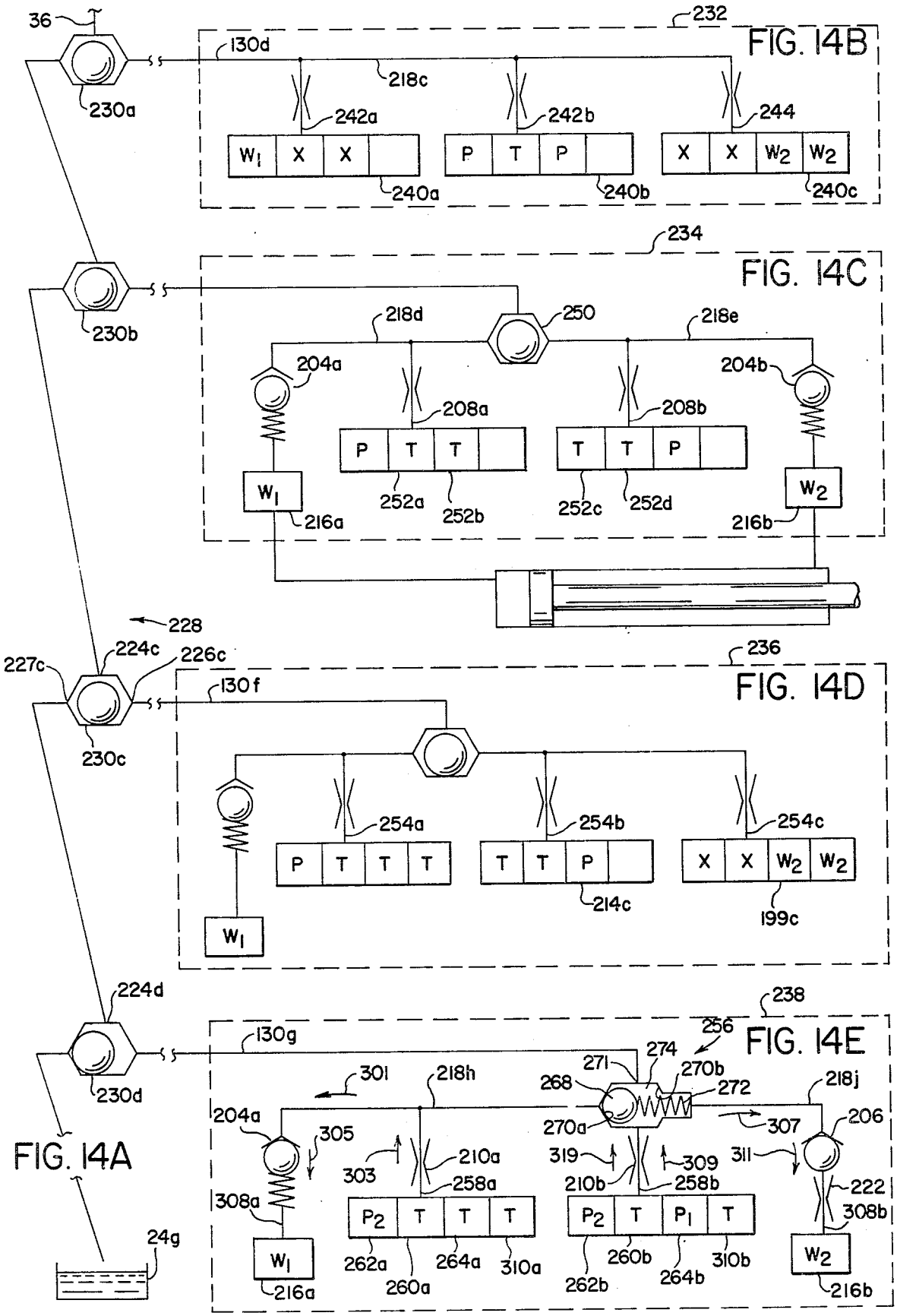
FIG. 14A is a schematic drawing of series-connected logic for interconnecting the valved signal means of FIGS. 14B–14E.
FIG. 14B is a schematic drawing of a valved signal means of a directional control valve, being adapted for use with the series-connected logic of FIG. 14A, but also being usable with the parallel-connected logic of FIG. 13A.
FIG. 14C is a schematic of a different valved signal means for use with the logic of FIG. 14A.
FIG. 14D is a schematic of a third variation of valved signal means for use with the logic of FIG. 14A.
FIG. 14E is a schematic of a fourth variation of valved signal means for use with the logic of FIG. 14A.

In like manner, if the reverse flow preventing means 206 of FIG. 14E imposes a fluid pressure differential, due to the flow rate of the signal fluid therethrough that is substantially equal to or greater than the fluid pressure effect of either the spring 32 or the spring 54, then the valve 206 incorporates a restrictor function such as that of the restrictor 222; and the valve 206 may be used in place of, or in cooperation with a separate restrictor such as the restrictor 222.

System with Series Logic

Referring now to FIGS. 14A–14E, series connected logic 228 includes three-port logic valves 230*a*, 230*b*, 230*c*, and 230*d* and is used to interconnect valved signal means 232, 234, 236, 238, and to select the highest signal pressure from any of the valved signal means 232, 234, 236, or 238. Series connected logic 228 functions the same as has been fully described in U.S. Pat. No. 3,971,216 of common inventor entity and common assignee; so that the description which has been included in the aforementioned patent is included herein by reference and no detailed description is required herein. However, it is worthy of note that the three-port logic valve 230*c* includes a first logic port 224*c* that is connected to either the effective output operator 28 of FIG. 3 or to the effective output operator 56 of FIG. 12 via the series-connected three-port logic valves 230*a* and 230*b* and via the signal conduit 36, a second logic port 226*c* that is connected to the control port 130*f* of FIG. 14D, and a third logic port 227*c* that is connected to the three-port logic valve 230*d* to sense the fluid pressure in the control port 130*g*.

Valved Signal Means for Series Logic

Referring now to FIG. 14B, the valved signal means 232 symbolizes the communications which a valved signal means would make in a four-position directional control valve that includes a float position. As illustrated by fourth-position boxes 240*a*, 240*b*, and 240*c*, signal passages 242*a* and 242*b* may be either blocked or communicated to a sump (not shown) as indicated by the absence of any symbol in the boxes 240*a* and 240*b*; and a signal or attenuation passage 244 is communicated to the second work port channel of the box 240*c*.

It is not important whether the attenuation passage 244 is communicated to second work port channel of the box 240*c*, or blocked, or communicated to a sump (not shown) except that one of the passages 242*a*, 242*b*, or 244 must be communicated either to a sump or to a work port channel when the directional control valve of the valved signal means 232 is in the float position. Since in a four-position valve having a float position, both work port channels are communicated to respective ones of the return channels, communication of the attenuation passages 244 to the second work port channel of the box 240*c* is effective to attenuate any signal pressure in a conduit 218*c* and in a control port 130*d*.

Referring now to valved signal means 234 to FIG. 14C, the valved signal means 234 is the same as and functions the same as valved signal means 192 of FIG. 13D except that: the valved signal means 234 includes two reverse flow preventing means, 240*a* and 240*b*, of the relief valve type rather than using one reverse flow preventing means of the check valve type such as the check valve 206 of the valved signal means 192, the valved signal means 232 includes a three-port logic valve 250*a* for selecting the synthetic signal pressure from the conduits 218*d* and 218*e* rather than using the check valves 212*a* and 212*b* of the valved signal means 192 of FIG. 13, the boxes 252*a* and 252*b* show the signal passage 208*a* communicating to a sump for the stand-by position and one operating position, and the boxes 252*d* and 252*c* show the signal passage 208*b* communicating to a sump for the stand-by and another operating position.

The advantages of the valved signal means 192 of FIG. 13D and the valved signal means 234 of FIG. 14C is that the valved signal means, 192 or 234, communicates directly with the work port channels 216*a* and 216*b* without being valved by the interaction of a valve spool and a valve body; so that it is possible to interpose a flow control valve (shown and described in copending application of same inventor entity and same filing date) between the valve spool and a work port of a directional control valve and to sense the load actuating pressure in one or both of the work port channels, 216*a* or 216*b*, without interference of this sensing function by the flow control device.

Valved signal means 236 of FIG. 14D is similar to the valved signal means 234 of FIG. 14C except that the furnishing of signal fluid from the pressure inlet channel of the box 214*c* to second work port channel of the box 199*c* by way of the signal passages 254*b* and 254*c* involves the valving both of the signal passages 254*b* and 254*c*; whereas, in the valved signal means 234 of FIG. 14C, the signal passage 208*b* is valved to the conduit 218*e* but fluid flow in the conduit 218*e* is in constant fluid communication with the second work port channel 216*b* via the relief valve 204*b*.

Referring now to valved signal means 238 of FIG. 14E, the valved signal means 238 schematically illustrates the valved signal communications that are made by the second preferred embodiment of the directional control valve as shown in FIGS. 15–18.

The valved signal means 238 of FIG. 14E includes a four-port connected logic valve 256, a control port 130*g*, signal passages 258*a* and 258*b*, and reverse flow preventing means or relief valve 204*a* and reverse flow preventing means or check valve 206.

In a stand-by position as indicated by boxes 260*a* and 260*b*, the signal passages 258*a* and 258*b* are both communicated to the return port means as indicated by the letter T in each of the boxes 260*a* and 260*b*; so that the control port 130*g*, a conduit 218*h*, and an unvalved logic port 271 are all connected with a sump, as indicated by the letter T in the box 260*b*, via a chamber 274 and the restrictor 210*b* to provide an attenuation flow path.

In a first operating position, as indicated by boxes 262*a* and 262*b*, both of the signal passages, 258*a* and 258*b*, are communicated to a secondary source of pressurized fluid as indicated by $P_2$ in the boxes 262*a* and 262*b*. At this time, a third fluid flow path or restricted flow path 301, that includes a valved or restricted flow path portion 303 and a restricted flow path portion 305 communicates pump fluid from the $P_2$ pressure inlet channel of the box 262*a* to the first work port channel 216*a* via restrictor 210*a* and reverse flow preventing means 204*a*; and the fluid pressure in the conduit 218*h* is effective to actuate a ball or shuttle 268 away from a valved logic port 270*a* and into sealing engagement with a valved logic port 270*b* against the opposition of a spring 272.

Thus, the supplying of an additional flow of signal fluid, from the $P_2$ pressure inlet channel of the box 262*b*, through the signal passage 258*b* and the restrictor 210*b* into a chamber 274 of the four-port connected logic valve 256, is effective to add this flow of signal fluid from the chamber 274 to the conduit 218*h* and to the second work port channel 216*a* via the relief valve 204*a* since the ball or shuttle 268 is not blocking the first valved logic port 270*a*.

In a second operating position as indicated by boxes 264*a* and 264*b* the conduit 218*h* is communicated to a return port means via the signal passage 258*a* and the restrictor 210*a* therein so that any fluid pressure in the conduit 218*h* is attenuated by flow to a sump. Thus the spring 272 is effective to seat the ball or shuttle 268 against the first valved logic port 270*a*. In the meantime the signal passage 258*b* is communicated to the pressure inlet channel as indicated by box 264*b*; and fluid from the pressure inlet channel of the box 264*b* is communicated to the second work port channel 216*b* by way of the conduit 218*j* and the check valve 206; so that a restricted flow path 307 is established that includes flow path portions 309 and 311.

Thus in both of the operating positions as described above, a supply of signal fluid flows to one of the work port channels, 216*a* or 216*b*, and this flow of signal fluid is pressurized by flowing through either the relief valve 204*a* or the restrictor 222.

The unique feature of the valved signal means 238 is that, when the directional control valve (FIGS. 15–18) of the valved signal means 238 is in a first operating position as indicated by boxes 262*a* and 262*b*, there are two separate flows of signal fluid being supplied to the first work port channel 216*a* from the pressure inlet channel. One of these flows of signal fluid is through the restrictor 210*a* and the other is through the restrictor 210*b*. The reason for the two flows of signal fluid to the first work port channel 216*a* is one of convenience in arranging and optimizing the various fluid channels within the directional control valve and this optimization is made possible by the four-port connection of the logic valve 256.

A Second Preferred Valve Embodiment

Referring now to FIGS. 15–18, directional control valve 280 includes valve body 282 which is shown in phantom and movable valving element or valve spool 284 which is slidably fitted into a spool bore 286.

Figure 15:
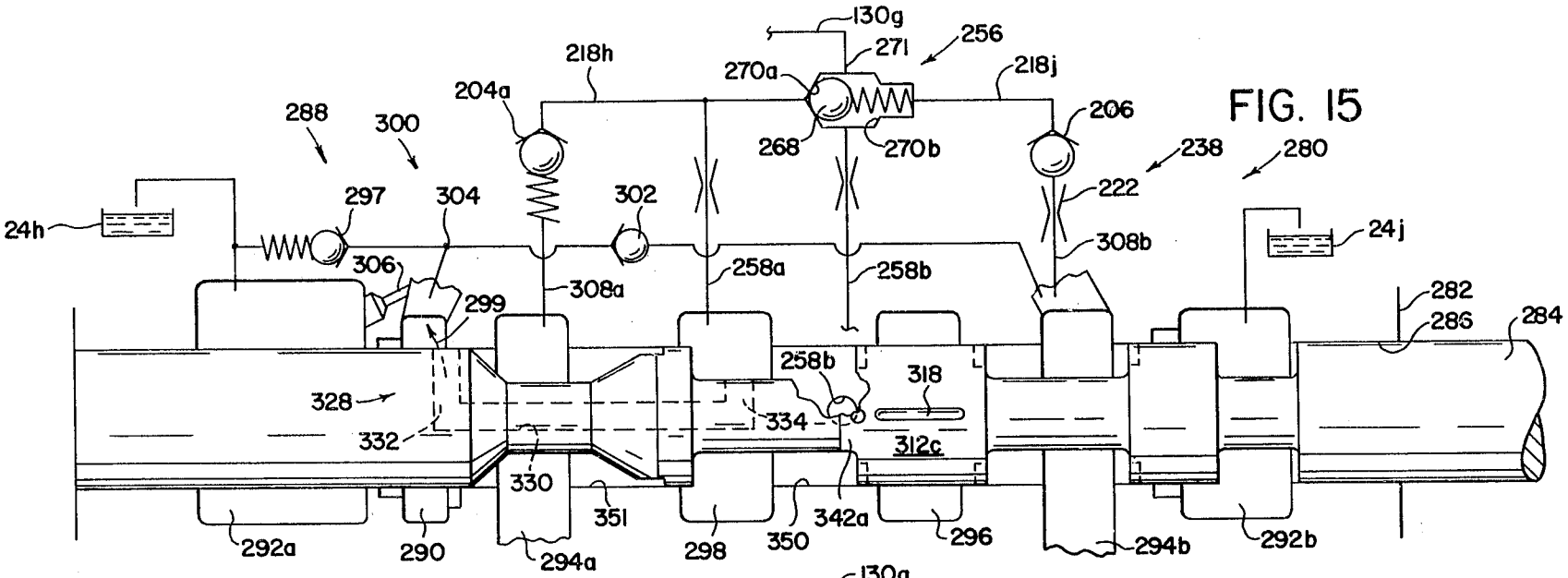
FIG. 15 is a partial and phantom cross-sectional drawing of a second preferred embodiment of a directional control valve of the present invention with cored passages of the valve body thereof outlined and with the valve spool thereof in the stand-by position.
Figure 16:
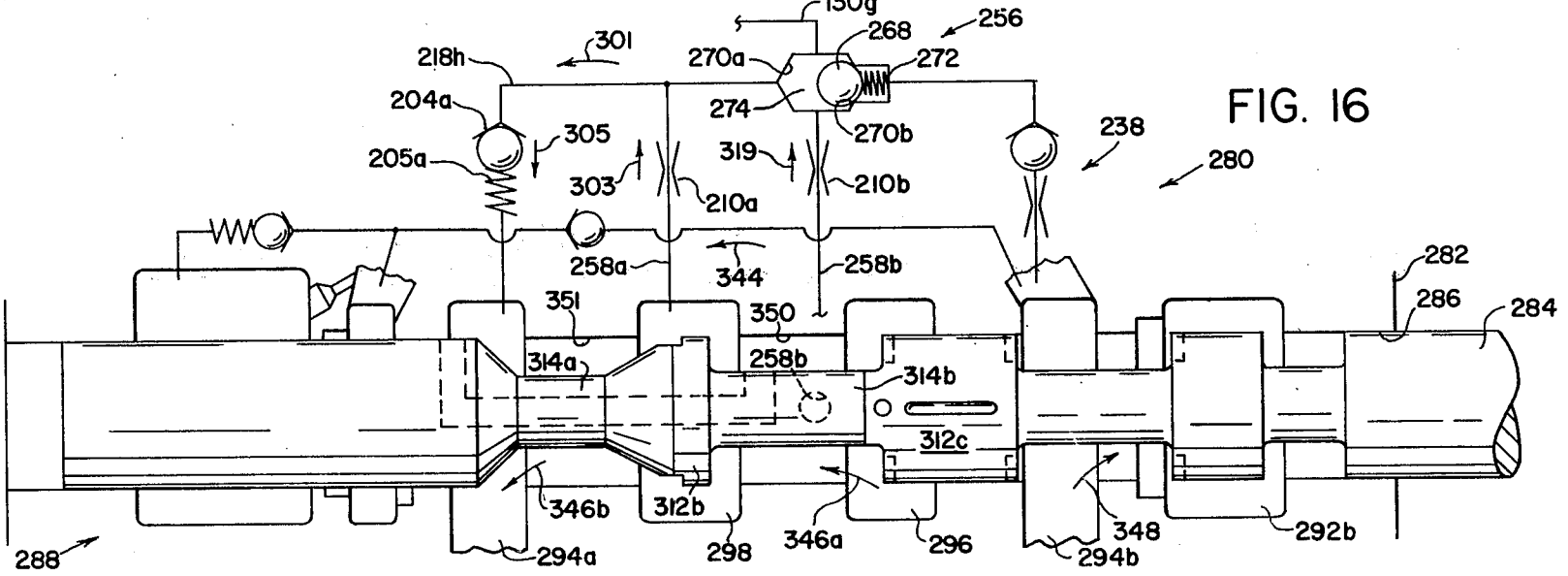
FIG. 16 is a partial and phantom cross-sectional drawing of the directional control valve of FIG. 15 but with the valve spool thereof moved to a first operating position.
Figure 17:
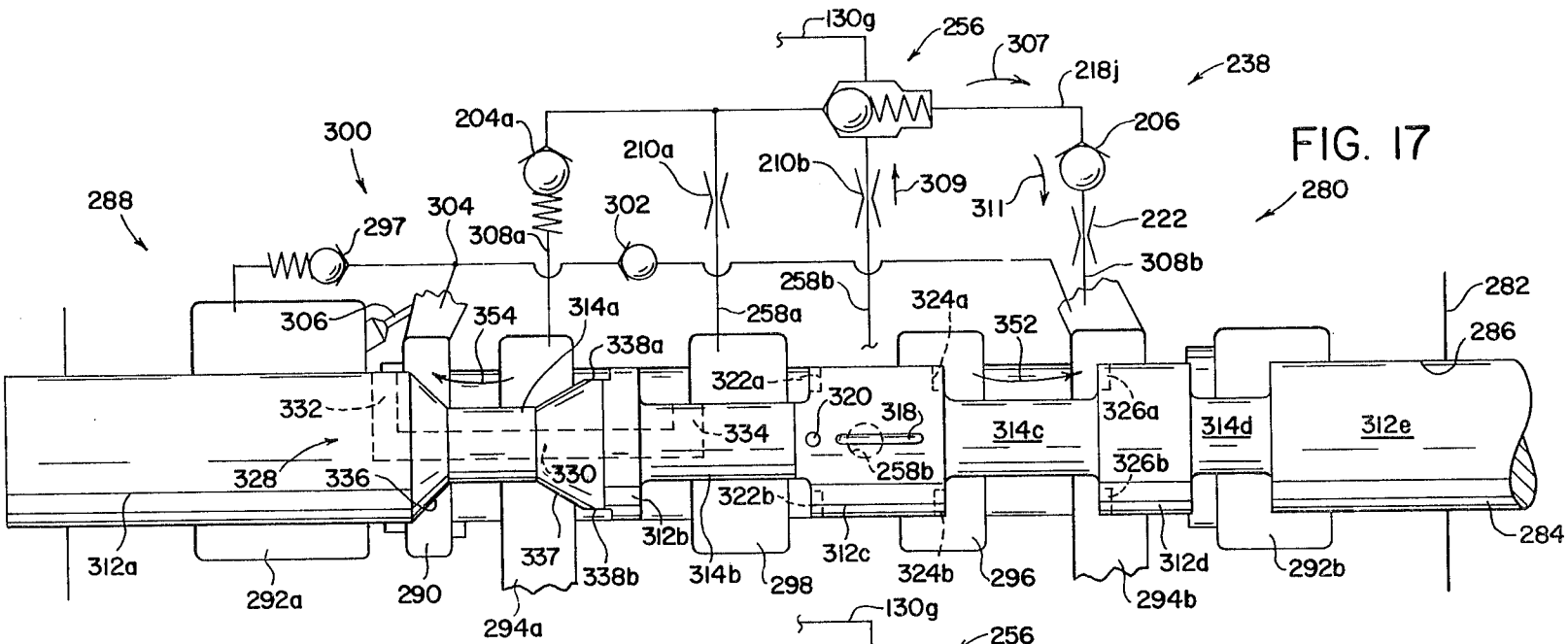
FIG. 17 is a partial and phantom cross-sectional drawing of the directional control valve of FIG. 15 but with the valve spool thereof moved to a second operating position.
Figure 18:
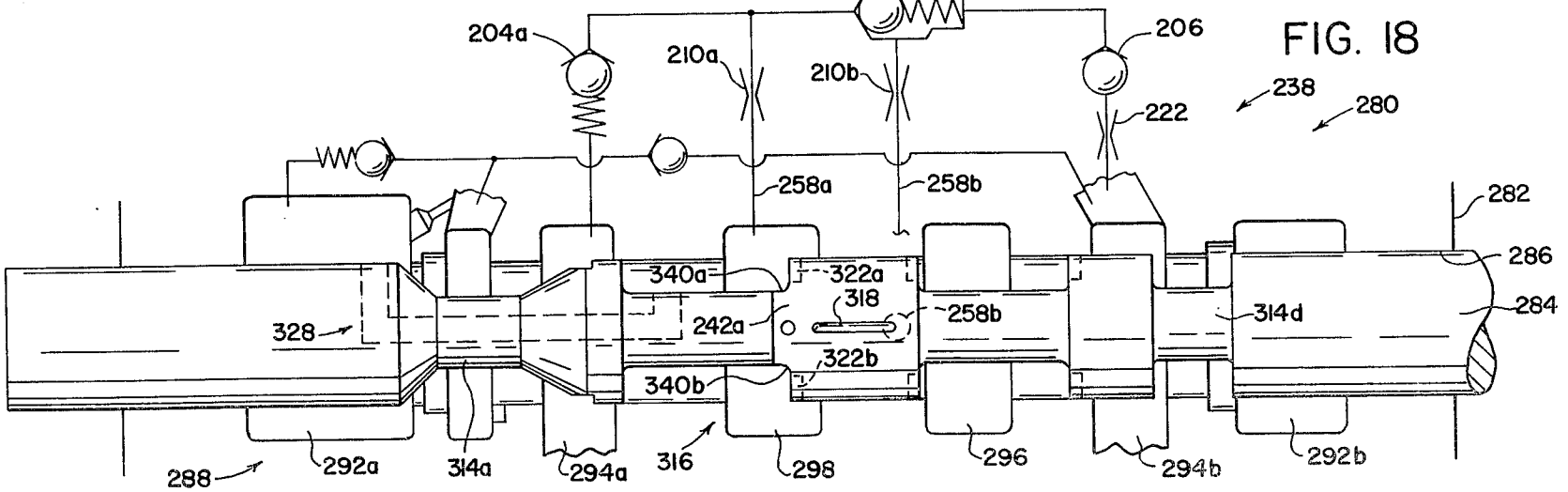
FIG. 18 is a partial and phantom cross-sectional drawing of the directional control valve of FIG. 15 but with the valve spool thereof moved to a float and regenerative position.

In the FIG. 15 illustration the valve spool 284 is in the stand-by position, in FIG. 16 the valve spool 284 has been moved to a first operating position, in FIG. 17 the valve spool 284 has been moved to a second operating position, and in FIG. 18 the valve spool 284 has been moved to a float and regenerative position.

Referring now to FIG. 15, the spool bore 286 of the valve body 282 is intercepted by a return port means 288 that includes a regenerative channel 290 and return channels 292a and 292b, first and second work port channels 294a and 294b, a pressure inlet channel 296, and an elongated circumferential groove 298 which serves as an intercepting means. The direction control valve 280 also includes a transfer or regenerative loop 300 which interconnects the second work port channel 294b and the regenerative channel 290. A regenerative check valve 302 is interposed into the transfer or regenerative loop 300 and is effective to prevent fluid flow from the second work port channel 294b to the regenerative channel 290. A low pressure relief valve 297 communicates the regenerative channel 290 to the first return channel 292a and thereby prevents applying excessive regenerative pressure to a point 304 and to the second work port channel 294b. An orifice 306 communicates the regenerative channel 290 with the first return channel 292a to provide an attenuation flow path, as will be subsequently described.

The second embodiment of FIGS. 15–18 includes a valved signal means 238 which is identical to the valved signal means 238 of FIG. 14E. There are four passages which communicate the valved signal means 238 with the spool bore 286 of the directional control valve 280. These four passages are signal passages 308a and 308b which correspond to like numbered passages for the valved signal means 238 of FIG. 14E, and signal passages 258a and 258b which correspond to the like numbered signal passages of the valved signal means 238 of FIG. 14E. Therefore, it is apparent that the schematic drawing of FIG. 14E symbolizes the operation of the portion of the directional control valve 280 of FIGS. 15–18 that is called valved signal means 238.

Referring now to FIG. 17, the valve spool 284 includes land portions 312a, 312b, 312c, 312d, and 312e; and the valve spool 284 also includes reduced cross-section portions 314a, 314b, 314c, and 314d. The land portion 312c includes a longitudinally extending groove 318, a radial balancing hole 320, metering notches 322a and 322b, and metering notches 324a and 324b. The valve spool 284 includes longitudinally disposed hole means 328 which includes hole 330 and cross-holes 332 and 334. Conical sections 336 and 337 are interposed between reduced cross-section portion 314a and respective ones of land portions 312a and 312b. Metering notches 338a and 338b intercept both the conical section 337 and the land portion 312b.

Referring now to FIG. 18, tang and notch means 316 includes notches 340a and 340b, the metering notches 322a and 322b, and a longitudinally extending tang 342a.

Referring now to FIG. 15, with the valve spool 284 in the stand-by position as shown, the pressure inlet channel 296 is isolated from the work port channels 294a and 294b; and the work port channels 294a and 294b are isolated from both the regenerative channel 290 and the return channels 292a and 292b.

Referring now to FIGS. 14E and 15, in the stand-by position, the signal passage 258a is communicated to the first return channel 292a via holes 334, 330, and 332, and the orifice 306 to provide an attenuation flow path or fluid flow path 299, and to make the return port communication which is illustrated by the box 260a of the valved signal means 238 of FIG. 14E. Also, the signal passage 258b is communicated to the first return channel 292a in a similar manner, seeing that the signal passage 258b is only partially blocked by the tank 342a of the land portion 312c. Thus the directional control valve 280 of the FIG. 15 embodiment makes the valved signal means communications which are schematically illustrated by the boxes 260a and 260b of FIG. 14E; and fluid pressure in the control port 130g is attenuated by fluid flow to the return channel 292a via an attenuation flow path 299 which includes the logic valve 256 and the signal passage 258b.

Referring now to FIG. 16, with the valve spool 284 moved to a first operating position as shown therein, a first fluid flow path 344, which includes flow path portions 346a and 346b has been established from the pressure inlet channel 296 to the first work port channel 294a; and a second fluid flow path 348 has been established from the second work port channel 294b to the second return channel 292b.

At this time, the attenuation flow path 299 of FIG. 15 which has been communicating the signal passage 258a with the regenerative channel 290 and with the first return channel 292a via the orifice 306, has now been occluded by movement of the cross-hole 332 to a position that is remote from the regenerative channel 290; and the signal passage 258b has been communicated with a bore portion 350 of the spool bore 286.

The valve spool 284 is timed with respect to the pressure inlet channel 296, the circumferential groove or intercepting means 298, and the work port channel 294a so that the fluid pressure in the bore portion 350 approximates the fluid pressure in the pressure inlet channel 296. The fluid pressure in the signal passage 258b is the $P_2$ pressure of the elongated groove 298 of FIG. 16 as indicated by the box 262b in FIG. 14E. Also, the same or nearly the same fluid pressure is applied to the signal passage 258a from the elongated groove 298 of FIG. 16, and this is represented by $P_2$ in the box 262a in FIG. 14E.

Therefore, not only is the third fluid flow path 301 established with portions 303 and 305 thereof, but also a flow path portion 319 is established from the signal passage 258b to the chamber 274 of the logic valve 256. The fluid pressure from the signal passage 258a is effective to actuate the ball 268 to the right against the force of the spring 272 and into sealing engagement with the valved logic port 270b, and to open the valved logic port 270a; so that pressurized fluid from both the flow path portion 303 and the flow path portion 319 flows to the work port channel 294a via the flow path portion 305.

Referring finally to FIG. 16, and the land portion 312b has a shorter length than does the groove 298. The first fluid flow path 344 is established by positioning the land portion 312b within the confines of the groove 298; and the first fluid flow path 344 includes the reduced cross-section portion 314b, the bore portion 350, the groove 298, another bore portion 351, and the reduced cross-section portion 314a.

Referring now to FIG. 17, the valve spool 284 has been moved to a second operating position wherein another first fluid flow path 352 has been established from the pressure inlet channel 296 to the second work port channel 294b; and another second fluid flow path 354 has been established from the first work port channel 294a to the regenerative channel 290 of the return port means 288. At this time, the first signal passage 258a is communicated to the first return channel 292a via the longitudinally disposed hole means 328 and the orifice 306; and the second signal passage 258b is communicated to the pressure inlet channel 296 via the longitudinally extending groove 318 of the land portion 312c. Thus the communications of the signal passages 258a and 258b are as illustrated by the boxes 264a and 264b of FIG. 14E; and the restricted flow path 307 with the portions 309 and 311 thereof are established as previously described for FIG. 14E.

Referring now to FIG. 18, the valve spool 284 has been moved to a float and regenerative position in which the first work port channel 294a is communicated to the first return channel 292a by the reduced cross-section portion 314a; and the second work port channel 294b is communicated to the second return channel 292b by the reduced cross-section portion 314d.

At this time, the first signal passage 258a is communicated to the first return channel 292a by the longitudinally disposed hole means 328; and the second signal passage 258b is communicated to the first return channel 292a by the longitudinally extending groove 318 and the longitudinally disposed hole means 328.

Therefore the valve embodiment of FIGS. 15–18 provides the functions of the valved signal means 238 of FIG. 14E as indicated by the boxes 262a and 262b, 260a and 260b, 264a and 264b, and 310a and 310b.

The directional control valve embodiment of FIGS. 15–18 is similar to the directional control valve of common inventor entity, common assignee, and common filing date which includes a flow control valve that is interposed between the valve spool 284 and the first work port channel 294a of the present invention; and the detailed description of the directional control valve of the referenced application of common filing date is included herein by reference thereto.

Second Embodiment with Flow Control

Figure 19:
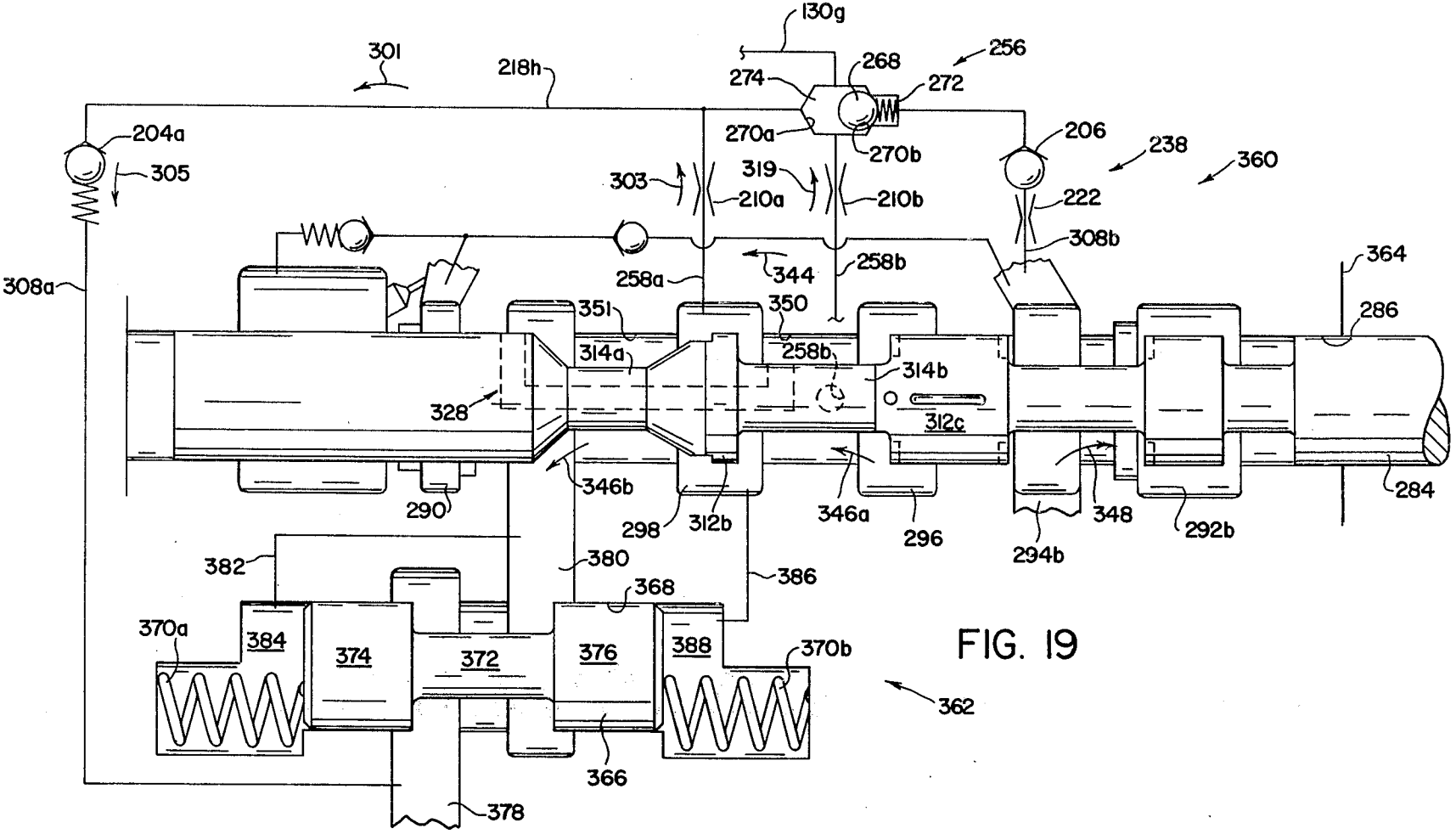
FIG. 19 is a partial and phantom cross-sectional drawing of the directional control valve of FIGS. 15–18 with a flow control interposed between the valve spool and one work port.

Referring now to FIG. 19, a directional control valve 360 is similar to the directional control valve 280 of FIGS. 15–18. The directional control valve 360 differs primarily in that a flow control means 362 is included in a body 364 of the directional control valve 360.

The flow control means 362 includes a plunger 366 that is slidably fitted into a plunger bore 368, that is spring centered by springs 370a and 370b, and that includes a reduced cross-section portion 372 intermediate of land portions 374 and 376.

A work port channel 378 and a service channel 380 intercept the plunger bore 368; and the service channel 380 intercepts the spool bore 286. A conduit 382 interconnects the service channel 380 and a chamber 384 for fluid pressure actuation of the plunger 366 in one direction; and a conduit 386 interconnects the circumferential groove 298 and a chamber 388 for fluid pressure actuation of the plunger 366 in the other direction.

The valved signal means 238 includes the same component parts and establishes the same fluid flow paths and has been described for FIGS. 15–18; but in FIG. 19, the work port channel 378 does not intercept the spool bore 286, so that the conduit 218h and the passage 308a have been lengthened and the relief valve 204a has been relocated.

The operation of the flow control means may be understood by reference to FIG. 19 along with FIGS. 15, 17 and 18 by those familiar to the art, or by reference to the detailed description, which is incorporated herein by reference thereto, of the copending patent application of common inventorship entity, common assignee, and common filing date.

Briefly, the valve spool 284 is movable to a first operating position wherein a flow path portion 346b is established and selectively sized, wherein fluid pressure upstream of the flow path portion 346b is supplied to the chamber 388 via the circumferential groove 298 and the conduit 386, and wherein the fluid pressure in the service channel 380 is supplied to the chamber 384 via the conduit 382. The plunger 366 is actuated by these two fluid pressures to maintain a rate of fluid flow that results in a substantially constant differential pressure between the groove 298 and the service channel 380 for fluid flow to the work port channel 378.

When the valve spool 284 is moved to the second operating position of FIG. 17, the chamber 388 is communicated to the regenerative channel 290 by the longitudinal hole means 328; so that the plunger 366 is actuated by fluid pressures in the service channel 380 and in the regenerative channel 290 to maintain a substantially constant pressure differential therebetween; whereby the rate of fluid flow from the work port channel 378 to the regenerative channel 290 is maintained substantially proportional to the sizing of the fluid flow path 354 of FIG. 17.

First Embodiment Details and Modifications

Referring now to FIGS. 1 and 1A, the signal passage 134a includes a first hole portion 131a and a second hole portion 133a that orthogonally intercept diametrically opposite sides of a cylindrical bore surface 129 of the spool bore 84; and, in like manner, the second signal passage 134b includes a first hole portion 131b and a second hole portion 133b.

The tangs 110a and 110b must be longitudinally and rotationally positioned to sealingly engage the cylindrical bore surface 129 where the first hole portions 131a and 131b intercept the spool bore 84 when the valve spool 94 is in the stand-by position. Second hole portions 133a and 133b are provided for the purpose of balancing radial pressure forces on the valve spool; and radial pressure balancing means, such as the radial balancing holes 112a and 112b of FIG. 1, or radial pressure balancing hole portions 113a, 113b, 115a, and 115b, must be provided to equalize the fluid pressures in respective hole portions of the signal passages 134a and 134b.

While it is desirable that the radial balancing holes 112a and 112b intercept both of the cylindrical surface portions, such as the cylindrical surface portions 150a and 150b of FIG. 7, at the same longitudinal position, it is not necessary that the balancing hole portions, such as the hole portions 115a and 115b, orthogonally intercept the cylindrical surface portions, such as the cylindrical surface portions 150a and 150b. Since machining ease, machining cycle time, and positional accuracy are enhanced by drilling from diametrically opposite sides of the valve spool 94, it is practical to longitudinally incline the balancing hole portions 113a, 113b, 115a, and 115b as desired as long as there is a hole means, such as the hole portions 115a and 115b that intercept the surface portions 150a and 150b and that intercommunicate the hole portions 131b and 133b.

The longitudinally extending grooves 106a and 106b of FIG. 1 provide passage means in the valve spool 94 for the establishing of the flow path portion 169; and the cross-sectional area of the groove can be sized to provide a fluid restriction in the flow path portion 169.

Alternately an elongated circumferential groove 139, as shown in FIG. 1A may be used as a passage means in a valve spool 141; and the diameter of the circumferential groove 139 may be sized to limit the conductance of the flow path portion 169.

Even if the circumferential groove 139 is not sufficiently long to communicate the pressure inlet channel 92 to the signal passage 134*a* to establish the flow path portion 169 and thereby to serve as a passage means in the valve spool 141, it will still function as a radial balancing means when the valve spool is moved to a longitudinal position wherein the circumferential groove 139 intercommunicates the hole portions 131*a* and 133*a*.

SUMMARIZING COMMENTS

Both the first embodiment of the directional control valve of the present invention as shown in FIGS. 1, 2, 6, and 8, and the second embodiment as shown in FIGS. 15–18, supply a flow of signal fluid to their respective work port channels and pressurize these signal fluids to respective synthetic signal pressures which are at a predetermined pressure magnitude above the load actuating pressures in the respective work port channels.

The portion of each directional control valve that controls the supplying of signal fluid to a respective one of the work port channels, and that pressurizes the signal fluid to synthetic signal pressures, is called the valved signal means and is typified by the valved signal means 128 of FIGS. 1, 2, 8, and 9, and the valved signal means 238 of FIGS. 15–18.

Valved signal means 238 is also shown in schematic form in FIG. 14E; and the similarities and differences of both the valved signal means 188 of FIG. 13B and the valved signal means 190 of FIG. 13C to the embodiment of FIGS. 1, 2, 8, and 9 have been discussed. Also, the functioning of valved signal means 192, 232, 234, and 236 of FIGS. 13D and 14B–14D have been described sufficiently that anyone skilled in the art could design a directional control valve embodying one of the valved signal means described herein or a variation thereof.

Each valved signal means establishes and occludes a fluid flow path or restricted flow path, such as the fluid flow path 166 of FIG. 8 or 301 of FIG. 16, or 307 of FIG. 17, from a source of pressurized fluid, such as the pressure inlet channel 92 of FIG. 8, to a work port channel, such as the work port channel 86*a* of FIG. 8.

Each restricted flow path, such as 166, 301, or 307, includes one flow path portion, such as 168, 303, or 309, that communicates a pressure inlet channel, 92 or 296, with a control port, 130 or 130*g*, and that includes a first fluid restrictor therein.

The first fluid restrictor may be the grooves 106*a* and 106*b* and/or restrictor 138*a* or 138*b* of FIG. 8, or 210*a* of FIG. 16, or 318 and/or 210*b* of FIG. 17.

Each restricted flow path also includes another flow path portion such as the flow path portion 170 of FIG. 8, 305 of FIG. 16, or 311 of FIG. 17, that communicates the control port, 130 or 130*g*, to a work port channel, 86*a*, 86*b*, 294*a*, or 294*b*.

These other flow path portions may be valved flow path portions, such as the flow path portion 170, or they may be one-way flow path portions, such as the flow path portions 305 and 311.

Each valved signal means includes reverse flow preventing means to prevent fluid from flowing from a work port channel, such as 86*a*, 216*a*, or 216*b*, to a control port, such as 130 or 130*g*, when the valve spool is in the stand-by position. This reverse flow preventing means may be a portion of a valve spool such as the tang 110*a* of the valve spool 94 of FIGS. 1 and 2, or the reverse flow preventing means may be a one-way flow and reverse flow restrictor valve such as the relief valve 204*a* or the check valve 206 of FIG. 15.

That is, a valved flow path portion, such as flow path portion 170 utilizes a portion of the valve spool, such as the tang 110*a* as a reverse flow preventing means; and a one-way flow path portion uses a relief valve, such as the relief valve 204*a* of FIG. 16, or a check valve, such as the check valve 206 of FIG. 17, as a reverse flow preventing means.

Preferably, each of these other flow path portions, 170, 305, and 311, includes second fluid restrictor means therein. This second fluid restrictor means may be the fixed conductance restriction of the restrictor or groove 146*a* of the one-way flow and restrictor valve 140*a* of FIG. 8, the fixed conductance restriction of the restrictor 138*a* of FIG. 8, the resiliently biased restrictor or relief valve 204*a* of FIG. 16 in which the resilient bias is provided by the spring 205*a*, the fixed conductance restrictor 222 of FIG. 17, the fixed conductance of the check valve 206 of FIG. 17, or both the resilient bias of the spring 205*a* and the fixed conductance through the relief valve 204*a* of FIG. 16.

That is, anything in a restricted flow path, such as the flow path 301 of FIG. 16, that increases the fluid pressure in a control port, 130 or 130*g*, above the load actuating pressure in a work port channel, 294*a*, by a pressure magnitude that is substantially equal to or greater than the stand-by pressure of the system as determined by the spring 32 of FIG. 3, or the spring 54 of FIG. 12, or that increases the signal pressure substantially equal to or more than 50 psi, is a second fluid restrictor means as defined herein.

Both of the embodiments of directional control valves, FIGS. 1, 2, 8, and 9, and FIGS. 15–18, are usable with both fixed displacement and variable displacement pumps as typified by FIGS. 3 and 12.

Both of the embodiments of directional control valves are usable with either the series-connected logic of FIG. 14A, or the parallel-connected logic in FIG. 14.

The valved signal means of FIGS. 14B–14E are usable with either the logic of FIG. 14A or the logic of FIG. 13A; but the valved signal means of FIGS. 13B–13D are only usable with the logic of FIG. 13A.

The three-port logic valve 230*d* of FIG. 14A is redundant as is the sump 24*g*; and the valved logic port 227*c* can be connected to the control port 130*g* without any change in functioning, as can be seen by inspection.

While there have been described above the principles of this invention in connection with specific apparatus, it is to be clearly understood that this description is made only by way of example and not as a limitation to the scope of the claims.

What is claimed is:

1. A load responsive hydraulic system (FIG. 3 or FIG. 12, + FIG. 1 or FIG. 15) which comprises a source (20 of FIG. 3, or 46 of FIG. 12) of pressurized fluid having a pump (22 or 48) and a sump (24*a* or 24*b*);

effective output means (26 or 60), being connected to said source and having an effective output operator (28 or 56), for controlling the effective output of said pump in response to fluid pressure applied to said effective output operator;

a fluid actuated device (156 of FIG. 1) having first (158*a*) and second (158*b*) actuating ports;

a directional control valve (80 of FIG. 1, or 280 of FIG. 15) having a pressure inlet channel (92 or 296) that is connected to said pump, having return port means (88 or 288) for return of excess fluid to said source, having a first work port channel (86*a* or 294*a*) that is connected to said first actuating port and a second work port channel (86*b* or 294*b*) that is connected to said second actuating port, and having movable valving element means (94 or 284) that is movable from a stand-by position (FIG. 1 or FIG. 15) to an operating position (FIG. 8 or FIG. 16), for establishing both a first fluid flow path (162 of FIG. 9, or 344 of FIG. 16) from said pressure inlet channel to said first work port channel and a second fluid flow path (164 of FIG. 9, or 348 of FIG. 16) from said second work port channel to said return port means as said valving element means is moved to said operating position, and for occluding both said first and second fluid flow paths when said valving element means is moved to said stand-by position;

valved signal means (128 or 238), including a control port (130 or 130*g*), for establishing a restricted flow path (166 of FIG. 8, or 301 of FIG. 16) from said pump to said first work port channel after said second fluid flow path is established, for providing a fluid restriction (106*a* or 138*b* of FIG. 8, or 258*a* of FIG. 16) in said restricted flow path, for sensing fluid pressure in said third fluid flow path intermediate of said fluid restriction and said first work port channel, for applying said sensed fluid pressure to said control port, and for occluding said restricted flow path before said occlusion of said second fluid flow path; and means (36, 230*a*, etc.) for applying said sensed fluid pressure to said effective output operator.

2. A load responsive hydraulic system as claimed in claim 1 in which said system includes means for attenuating (160 of FIG. 1, 299 of FIG. 15, or 185 of FIG. 13A) said sensed fluid pressure when said valving element means (94 or 284) is in said stand-by position (FIG. 1 or FIG. 15).

3. A load responsive hydraulic system as claimed in claim 2 in which said attenuating means comprises an attenuation flow path (160 or 299) that is established from said control port (130 or 130*g*) to said sump by said directional control valve (80 or 280) when valving element means is in said stand-by position (FIG. 1 or FIG. 15).

4. A load responsive hydraulic system as claimed in claim 2 in which said attenuating means comprises a fluid restrictor (185 of FIG. 13A) that communicates said effective output operator (28 of FIG. 3 or 56 of FIG. 12) to said sump.

5. A load responsive hydraulic system as claimed in claim 1 in which said valved signal means (128 of FIG. 1, or 238 of FIG. 15) includes second fluid restriction means (138*a* or 146*a* of FIG. 1, or 204*a* or 222 of FIG. 15) for providing a predetermined resistance of fluid flow from said control port (130 or 130*g*) to said first work port channel (86*a* or 294*a*).

6. A load responsive hydraulic system (FIG. 3 or FIG. 12, + FIG. 1 or FIG. 15) which comprises a source (20 or 46) of presurized fluid having a pump (22 or 48) and a sump (24*a* or 24*b*);

effective output means (26 or 60), being connected to said source and having an effective output operator (28 or 56), for controlling the effective output of said pump in response to fluid pressure applied to said effective output operator;

a fluid actuated device (156) having first (158*a*) and second (158*b*) actuating ports;

a directional control valve (80 or 280) having a pressure inlet channel (92 or 296) that is connected to said pump, having return port means (88 or 288) for return of excess fluid to said source, having a first work port channel (86*a* or 294*a* ) that is connected to said first actuating port and a second work port channel (86*b* or 294*b*) that is connected to said second actuating port, and having movable valving element means (94 or 284) that is movable from a stand-by position (FIG. 1, or FIG. 15) to an operating position (FIG. 8, or FIG. 16, or FIG. 17), for establishing both a first fluid flow path (162 of FIG. 9, 163 of FIG. 1, 344 of FIG. 16, or 352 of FIG. 17) from said pressure inlet channel to said first work port channel and a second fluid flow path (348) from said second work port channel to said return port means as said valving element means is moved to said operating position, and for occluding both said first and second fluid flow paths when said valving element means is moved to said stand-by position;

valved signal means (128 or 238), including a control port (130 or 130*g*), for establishing a restricted flow path (166 or FIG. 8, 167 of FIG. 1, 301 of FIG. 16, or 307 of FIG. 17) from said pump to said first work port channel after said second fluid flow path is established, for providing a fluid restriction (106*a* or 138*b* of FIG. 8, 210*a* of FIG. 16, or 210*b* or 318 of FIG. 17) in said restricted flow path, for sensing fluid pressure in said restricted flow path intermediate of said fluid restriction and said first work port channel, for applying said sensed fluid pressure to said control port, and for occluding said restricted flow path before said occlusion of said second fluid flow path; and logic means (182*a* + 182*b* of FIG. 13A, or 230*a* + 230*b* of FIG. 14A), having a first logic port (183 of FIG. 13A, or 224*c* of FIG. 14A) that is connected to said effective output operator, having a second logic port (179*a* of FIG. 13A, or 226*c* of FIG. 14A) that is connected to said control port, and having a third logic port (179*b* of FIG. 13A, or 227*c* of FIG. 14A) that is adapted for connection to a fluid pressure, for establishing fluid communication to said first logic port and to said effective output operator from the one of the other two of said logic ports having the higher fluid pressure therein, and for preventing fluid flow from said first logic port to the one of said two other logic ports with the lower fluid pressure therein.

7. A load responsive hydraulic system as claimed in claim 6 in which said logic means comprises a three-port logic valve (230*c* of FIG. 14A).

8. A load responsive hydraulic system as claimed in claim 6 in which said logic means comprises a first one-way flow valve (182*a*) communicating said control port (130 or 130*g*) to said effective output operator (28 or 56) and preventing reverse flow therebetween, and a second one-way flow valve (182*b*) communicating said third logic port (179*b*) to said effective output operator and preventing reverse flow therebetween.

9. A load responsive hydraulic system as claimed in claim 8 in which said system includes means for attenuating (160 of FIG. 1, 299 of FIG. 15, or 185 of FIG.

13A) said higher fluid pressure applied to said effective output operator when said valving element means is in said stand-by position (FIG. 1, or FIG. 15).

10. A load responsive hydraulic system as claimed in claim 9 in which said attenuating means comprises a fourth fluid flow path (160 of FIG. 1, or 299 of FIG. 15) that is established from said control port (130 or 130*g*) to said sump by said directional control valve (80 or 280) when said valving element means (94 or 284) is in said stand-by position (FIG. 1 or FIG. 15).

11. A load responsive hydraulic system as claimed in claim 9 in which said attenuating means comprises a restrictor (185 of FIG. 13A) that communicates said effective output operator (28 of FIG 3, or 56 of FIG. 12) to said sump (24*f* of FIG. 13A).

12. A load responsive hydraulic system as claimed in claim 8 in which said valved signal means (128 or 238) includes second fluid restrictor means (138*a* or 146*a* of FIG. 8, or 204*a* of FIG. 16, or 222 of FIG. 17) for providing predetermined resistance to fluid flow from said control port (130 or 130*g*) to said first work port channel (86*a*, 294*a*, or 294*b*).

13. A load responsive hydraulic system (FIG. 3 or FIG. 12,+FIG. 1 or FIG. 15) of the type having a source (20 or 46) of pressurized fluid that includes a pump (22 or 48) and a sump (24*a* or 24*b*), having effective output means (26 or 60) that includes an effective output operator (28 or 56) for control of the pressure and effective output of said pump in response to a signal pressure applied to said effective output operator, having a fluid actuated device (156) that includes first (158*a*) and second (158*b*) actuating ports, and having a directional control valve (80 or 280) that is operatively connected to said source and to said actuating ports and that includes movable valving element means (94 or 284) for establishing a first fluid flow path (162, or 344=346*a*+346*b*) from said pump to said first actuating port at the load actuating pressure of said device and for establishing a second fluid flow path (164 or 348) from said second actuating port to said sump when said valving element means is moved to an operating position, an for occluding said first and second fluid flow paths when said valving element means is moved to a stand-by position, the improvement which comprises:

valved signal means (128 or 238), comprising a control port (130 or 130*g*), comprising first (134*a* or 258*a*) and second (134*b* or 308*a*) signal passages in said directional control valve that communicate with said movable valving element means, and comprising cooperating portions (106*a*+102+1-10*a*, or 314*b*+312*c*) of said valving element means, for supplying signal fluid from said pump to said first actuating port after said second fluid flow path is established, for pressurizing said signal fluid into a predetermined pressure relationship to said load actuating pressure, and for occluding said supply of signal fluid before said occluding of said second fluid flow path; and means (36), being operatively connected to said valved signal means and to said effective output operator, for applying said pressurized signal fluid to said effective output operator.

14. A load responsive hydraulic system as claimed in claim 13 in which said predetermined pressure relationship comprises pressurizing said signal fluid to a predetermined pressure magnitude above said load actuating pressure.

15. A load responsive hydraulic system (FIG. 3 or FIG. 12,+FIG. 1 or FIG. 15) of the type having a source (20 or 46) of pressurized fluid that includes a pump (22 or 48) and a sump (24*a* or 24*b*), having effective output means (26 or 60) that includes an effective output operator (28 or 56) for control of the pressure and effective output of said pump in response to a signal pressure applied to said effective output operator, having a fluid actuated device (156) that includes first (158*a*) and second (158*b*) actuating ports, and having a directional control valve (80 or 280) that includes a pressure inlet channel (92 or 296) connected to said source, that includes first (86*a* or 294*a*) and second (86*b* or 294*b*) work port channels operatively connected to respective ones of said actuating ports, that includes return port means (88 or 288) operatively connected to said sump, and that includes movable valving element means (94 or 284) for establishing both a first fluid flow path (162, or 344=346*a*+346*b*) from said pump to said first actuating port at the load actuating pressure of said device and a second fluid flow path (164 or 348) from said second actuating port to said return port means when said valving element means is moved to an operating position, and for occluding said first and second fluid flow paths when said valving element means is moved to a stand-by position, the improvement which comprises:

valved signal means (128 or 238), comprising a control port (130 or 130*g*), comprising first (134*a* or 258*a*) and second (134*b* or 308*a*) signal passages in said directional control valve that communicate with said movable valving element means, and comprising cooperating portions (106*a*+102+1-10*a*, or 318+314*b*+312*c*) of said valving element means, for establishing a third fluid flow path (166 of FIG. 8, or 301 of FIG. 16) from said pressure inlet channel to said first work port channel after said second fluid flow path is established, for providing a fluid restriction (106*a* or 138*b* of FIG. 8, or 258*a* of FIG. 16) in said third fluid flow path, for sensing fluid pressure in said third fluid flow path intermediate of said fluid restriction and said first work port channel, for applying said sensed fluid pressure to said control port, and for occluding said restricted flow path before said occlusion of said second fluid flow path; and means (36, 230*a*, etc.), being operatively connected to said control port and to said effective output operator, for applying said sensed fluid pressure to said effective output operator.

16. A load responsive hydraulic system (FIG. 3 or FIG. 12,+FIG. 1 or FIG. 15) as claimed in claim 15 in which said control valve includes second fluid restriction means (138*a* or 146*a* of FIG. 8, or 204*a* or 222 of FIGS. 14E & 15), being inserted into said third fluid flow path (166 of FIG. 8, 301 of FIGS. 14E & 15, or 307 of FIGS. 14E & 15) intermediate of said first work port channel (86*a*, 294*a*, or 294*b*) and said communicating of said third fluid flow path to said control port (130 or 130*g*), for providing a predetermined resistance to fluid flow from first said fluid restriction (138*b*, 210*a*, or 210*b*) to said first work port channel (86*a*, 294*a*, or 294*b*).

17. A load responsive hydraulic system (FIG. 3 or FIG. 12,+FIG. 1 or FIG. 15) as claimed in claim 16 in which said second fluid restrictor means comprises a fixed conductance restrictor (138*a* or 146*a* of FIG. 8, or 222 of FIGS. 14E and 15).

18. A load responsive hydraulic system ( FIG. 3 or FIG. 12,+FIG. 15) as claimed in claim 16 in which said second fluid restrictor means comprises a resiliently biased fluid restrictor (204*a* of FIGS. 14E and 15).

19. A load responsive hydraulic system (FIG. 3 or FIG. 12,+FIG. 1 or FIG. 15) as claimed in claim 15 in which said third fluid flow path of said valved signal means (128 of FIG. 8, or 238 of FIGS. 14E & 15) comprises series-connected first (168 of FIG. 8, or 303 of FIGS. 14E & 16, or 309 of FIGS. 14E & 17) and second (170 of FIG. 8, or 305 of FIGS. 14E & 16, or 311 of FIGS. 14E & 17) flow path portions with said first flow path portion communicating with said pressure inlet channel (92 or 296), with said second flow path portion communicating with said first work port channel (86*a*, 294*a*, or 294*b*), with said fluid restriction (138*b* of FIG. 8, or 210*a* or 210*b* of FIGS. 14E & 15) thereof being disposed in said first flow path portion, with said communicating to said control port (130 or 130*g*) being from said series connection (132 of FIG. 8, or 218*h* or 218*j* of FIGS. 14E & 15) of said first and second flow path portions, and with said establishing and occluding of said third fluid flow path comprising establishing and occluding one (168 or 170 of FIG. 8, or 303 of FIGS. 14E & 16, or 309 of FIGS. 14E & 17) of said flow path portions; and means (110*a* of FIG. 2, or 204*a* or 206 of FIGS. 14E & 15) for preventing reverse fluid flow from said first work port channel (86*a* of FIG. 8, or 216*a* or 216*b* of FIGS. 14E & 15) to said control port via said second flow path portion when said movable valving element means (94 or 284) is in said stand-by position (FIG. 1 or FIG. 15).

20. A load responsive hydraulic system (FIG. 3 or FIG. 12,+FIG. 1) as claimed in claim 19 in which said means for preventing reverse fluid flow comprises occluding (by 110*a* of FIG. 2) said second flow path portion (170 of FIG. 8) when said movable valving element means (94) is in said stand-by position (FIG. 1).

21. A load responsive hydraulic system (FIG. 3 or FIG. 12+FIG. 1) as claimed in claim 20 in which said second fluid flow path (164 of FIG. 9) is established before said second flow path portion (170 of FIG. 8) of said third fluid flow path (166 of FIG. 8) is established and said second flow path portion (170 of FIG. 8) is established before said first flow path portion (168 of FIG. 8) is established (via 106*a* of FIG. 8) as said valving element means (94) is moved to said operating position (FIGS. 8 and 9); and said first flow path portion (168 of FIG. 8) is occluded before said second flow path portion (170 of FIG. 8) is occluded and said second flow path portion (170 of FIG. 8) is occluded before said second fluid flow path (164 of FIG. 9) is occluded as said valving element means is moved to said stand-by position (FIGS. 1 and 2).

22. A load responsive hydraulic system (FIG. 3 or FIG. 12,+FIG. 15) as claimed in claim 19 in which said means for preventing reverse flow comprises one-way flow means (204*a* or 206 of FIGS. 14E & 15), being interposed into said second flow path portion (305 of FIGS. 14E & 16, or 311 of FIGS. 14E & 17), for restricting fluid communication from said first work port channel (216*a* or 216*b* of FIGS. 14E & 15) to said control port (130*g*).

23. A load responsive hydraulic system (FIG. 3 or FIG. 12,+FIG. 15) as claimed in claim 22 in which said one-way flow means comprises a check valve (206 of FIGS. 14E & 15).

24. A load responsive hydraulic system (FIG. 3 or FIG. 12,+FIG. 15) as claimed in claim 22 in which said one-way flow means comprises a resiliently biased fluid restrictor (204*a* of FIGS. 14E and 15).

25. A load responsive hydraulic system (FIG. 3 or FIG. 12,+FIG. 1 or FIG. 15) as claimed in claim 15 in which said movable valving element means (94 of FIG. 1, or 284 of FIG. 15) includes cooperating portions (98+126+148 of FIG. 1, or 330+332+334 of FIG. 15) thereof for establishing a fourth fluid flow path (160 of FIG. 1, or 299 of FIG. 15) from said control port (130 of FIG. 1, or 130*g* of FIG. 15) to said return port means (88 of FIG. 2, or 288 of FIG. 15) when said valving element means is in said stand-by position (FIGS. 1 and 2, or FIG. 15) and for occluding said fourth fluid flow path when said third fluid flow path (166 of FIG. 8, or 301 of FIG. 16, or 307 of FIG. 17) is established.

26. A load responsive hydraulic system (FIG. 3 or FIG. 12,+FIG. 1 or FIG. 15) as claimed in claim 25 in which said fourth fluid flow path (160 of FIG. 1, or 299 of FIG. 15) is occluded before said third fluid flow path (166 of FIG. 8, or 301 of FIG. 16, or 307 of FIG. 17) is established as said valving element means is moved from said stand-by position (FIGS. 1 and 2, or FIG. 15) to said operating position (FIGS. 8 and 9, or FIG. 16, or FIG. 17); and said fourth fluid flow path is established after said third fluid flow path is occluded as said valving element means is moved from said operating position to said stand-by position.

27. A load responsive hydraulic system (FIG. 3 or FIG. 12,+FIG. 1) as claimed in claim 15 in which said directional control valve (80) comprises a valve body (82) having a spool bore (84) therein;

said movable valving element means comprises a valve spool (94) being slidably inserted into said spool bore and having a land portion (100); and said valved signal means (128) comprises a pair of longitudinally extending grooves (106*a* & 106*b*) in said land portion.

28. A load responsive hydraulic system (FIG. 3 or FIG. 12,+FIG. 1) as claimed in claim 15 in which said directional control valve (80) comprises a valve body (82) having a spool bore (84) therein;

said movable valving element means comprises a valve spool (94) being slidably inserted into said spool bore and having a land portion (100); and said valved signal means (128) both comprises a longitudinally extending tang 110*a* that is formed on one end of said land portion by a pair of diametrically opposite tang notches (118*a* & 118*b*), and radial pressure balancing means, comprising a hole (112*a*) that is transversely disposed in said valve spool, for providing radial pressure balancing to said longitudinally extending tang.

29. A load responsive hydraulic system (FIG. 3 or FIG. 12,+FIG. 1) as claimed in claim 15 in which said directional control valve (80) comprises a valve body (82) having a spool bore (84) therein;

said return port means (88) comprises first (90*a*) and second (90*b*) return port channels that intercept said spool bore at spaced-apart locations;

said work port channels (90*a* & 90*b*) intercept said spool bore at spaced-apart locations intermediate of said return port channels;

said pressure inlet channel (92) intercepts said spool bore intermediate of said work port channels; and said communicating of said signal passages (134*a* & 134*b*) with said movable valving element means (94) comprises said signal passages intercepting said spool bore intermediate of said pressure inlet channel and respective ones of said work port channels.

30. A load responsive hydraulic system (FIG. 3 or FIG. 12,+FIG. 15) as claimed in claim 15 in which said directional control valve (280) comprises a valve body (282) having a spool bore (286) therein;

said return port means (288) comprises two (292*a* & 292*b*) return port channels that intercept said spool bore in spaced-apart locations;

said work port channels (294*a* & 294*b*) intercept said spool bore in spaced-apart locations intermediate of said return port channels;

said pressure inlet channel (296) intercepts said spool bore intermediate of said work port channels;

said communicating of one (308*a* or 308*b*) of said signal passages with said movable valving element means (284) comprises said one signal passage (308*a* or 308*b*) intercepting one (294*a* or 294*b*) of said work port channels; and said communicating of the other (258*a* or 258*b*) of said signal passages with said movable valving element means (284) comprises said other (258*a* or 258*b*) signal passage intercepting said spool bore intermediate of said pressure inlet channel and one of said work port channels.

31. A load responsive hydraulic system (FIG. 3 or FIG. 12,+FIG. 1 or FIG. 15) of the type having a source (20 or 46) of pressurized fluid that includes a pump (22 or 48) and a sump (24*a* or 24*b*), having effective output means (26 or 60) that includes an effective output operator (28 or 56) for control of the pressure and effective output of said pump in response to a signal pressure applied to said effective output operator, having a fluid actuated device (156) that includes first (158*a*) and second (158*b*) actuating ports, and having a directional control valve (80 or 280) that includes a pressure inlet channel (92 or 296) connected to said source, that includes first (86*a* or 294*a*) and second (86*b* or 294*b*) work port channels operatively connected to respective ones of said actuating ports, that includes return port means (88 or 288) operatively connected to said sump, and that includes movable valving element means (94 or 284) for establishing both a first fluid flow path (162, or 344=346*a*+346*b*) from said pump to said first actuating port at the load actuating pressure of said device and a second fluid flow path (164 or 348) from said second actuating port to said return port means when said valving element means is moved to an operating position, and for occluding said first and second fluid flow paths when said valving element means is moved to a stand-by position, the improvement which comprises:

valved signal means (128 or 238), comprising a control port (130 or 130*g*), comprising first (134*a* or 254*a*) and second (134*b* or 308*a*) signal passages in said directional control valve that communicates with said movable valving element means, and comprising cooperating portions (106*a*+102+110*a*, or 318+314*b*+312*c*) of said valving element means, for establishing a third fluid flow path (166 of FIG. 8, 167 of FIG. 1, 301 of FIG. 16, or 307 of FIG. 17) from said pump to said first work port channel after said second fluid flow path is established, for providing a fluid restriction (106*a* or 138*b* of FIG. 8, 210*a* of FIG. 16, or 210*b* or 318 of FIG. 17) in said third fluid flow path, for sensing fluid pressure in said third fluid flow path intermediate of said fluid restriction and said first work port channel, for applying said sensed fluid pressure to said control port, and for occluding said restricted flow path before said occlusion of said second fluid flow path; and logic means (182*a*+182*b* of FIG. 13A, or 230*a*+230*b* of FIG. 14A), having a first logic port (183 of FIG. 13A, or 224*c* of FIG. 14A) that is connected to said effective output operator, having a second logic port (179*a* of FIG. 13A, or 226*c* of FIG. 14A) that is connected to said control port, and having a third logic port (179*b* of FIG. 13A, or 227*c* of FIG. 14A) that is adapted for connection to a fluid pressure, for establishing fluid communication to said first logic port and to said effective output operator from the one of the other two of said logic ports having the higher fluid pressure therein, and for preventing fluid flow from said first logic port to the one of said two other logic ports with the lower fluid pressure therein.

32. A load responsive hydraulic system (FIG. 3 or FIG. 12,+FIG. 1 or FIG. 15,+FIG. 14A) as claimed in claim 31 in which said logic means comprises a three-port logic valve (230*c* of FIG. 14A.

33. A load responsive hydraulic system (FIG. 3 or FIG. 12,+FIG. 1 or FIG. 15,+FIG. 13A) as claimed in claim 31 in which said logic means comprises a first one-way flow valve (182*a*) communicating said control port (130 or 130*g*) to said effective output operator (28 or 56) and preventing reverse flow therebetween, and a second one-way flow valve (182*b*) communicating said third logic port (179*d*) to said effective output operator in preventing reverse flow therebetween.

34. A load responsive hydraulic system (FIG. 3 or FIG. 12,+FIG. 1 or FIG. 15) as claimed in claim 31 in which said system includes means for attenuating (160 of FIG. 1, 299 of FIG. 15, or 185 of FIG. 13A) said higher fluid pressure applied to said effective output operator when said valving element means is in said stand-by position (FIG. 1, or FIG. 15).

35. A load responsive hydraulic system (FIG. 3 or FIG. 12,+FIG. 1 or FIG. 15) as claimed in claim 34 in which said attenuating means comprises a fourth fluid flow path (160 of FIG. 1, or 299 of FIG. 15) that is established from said control port (130 or 130*g*) to said sump by said directional control valve (80 or 280) when said valving element means (94 or 284) is in said stand-by position (FIG. 1 or FIG. 15).

36. A load responsive hydraulic system (FIG. 3 or FIG. 12,+FIG. 1 or FIG. 15,+FIG. 13A) as claimed in claim 34 in which said attenuating means comprises a restrictor (185 of FIG. 13A) that communicates said effective output operator (28 of FIG. 3, or 56 of FIG. 12) to said sump (24*f* of FIG. 13A).

37. A load responsive hydraulic system (FIG. 3 or FIG. 12,+FIG. 1 or FIG. 15) as claimed in claim 31 in which said valved signal means (128 or 238) includes second fluid restrictor means (138*a* or 146*a* of FIG. 8, or 204*a* of FIG. 16, or 222 of FIG. 17) for providing predetermined resistance to fluid flow from said control port (130 or 130*g*) to said first work port channel (86*a*, 294*a*, or 294*b*).

38. A load responsive hydraulic system (FIG. 3 or FIG. 12,+FIG. 1 or FIG. 15) of the type having a source (20 or 46) of pressurized fluid that includes a pump (22 or 48) and a sump 24*a* or 24*b*), having effective output means (26 or 60) that includes an effective output operator (28 or 56) for control of the pressure and effective output of said pump in response to a signal pressure applied to said effective output operator, having a fluid actuated device (156) that includes first (158*a*) and second (158*b*) actuating ports, and having a directional control valve (80 or 280) that includes a pressure inlet channel (92 or 296) connected to said source, that includes first (86*a* or 294*a*) and second (86*b* or 294*b*) work port channels operatively connected to respective ones of said actuating ports, that includes return port means (88 or 288) operatively connected to said sump, and that includes movable valving element means (94 or 284) for establishing both a first fluid flow path (162, or 344=346*a*+346*b*) from said pump to said first actuating port at the load actuating pressure of said device and a second fluid flow path (164 or 348) from said second actuating port to said return port means when said valving element means is moved to a first operating position, for establishing both a third fluid flow path from said pump to said second actuating port and a fourth fluid flow path from said first actuating port to said return port means when said valving element means is moved to a second operating position, and for occluding all of said fluid flow paths when said valving element means is moved to a stand-by position, the improvement which comprises:

valved signal means (128 or 238), comprising a control port (130 or 130*g*), comprising first (134*a* or 258*a*) and second (134*b* or 308*a*) signal passages in said directional control valve that communicate with said movable valving element means, and comprising cooperating portions (106*a*+102+110*a*, or 318+314*b*+312*c*) of said valving element means, for establishing a first restricted flow path portion (170 of FIGS. 8 & 13C, or 305 of FIGS. 14E & 16) from said control port to said first work port channel after said second fluid flow path is established and for occluding said first restricted flow path portion before said second fluid flow path is occluded, for establishing a second restricted flow path portion (168 of FIGS. 8 & 13C, or 303 of FIGS. 14E & 16) from said pressure inlet channel to said control port after said first restricted flow path portion is established and for occluding said second restricted flow path portion before said first restricted flow path portion is occluded, for establishing a third restricted flow path portion (171 of FIGS. 1 & 13C, or 311 of FIGS. 14E & 17) from said control port to said second work port channel after said fourth fluid flow path is established and for occluding said third restricted flow path portion before said fourth fluid flow path is occluded, and for establishing a fourth restricted flow path portion (169 of FIGS. 1 & 13C, or 309 of FIGS. 14E & 17) from said pressure inlet channel to said control port and for occluding said fourth restricted flow path portion before said third restricted flow path portion is occluded; and means (36, 230*a*, etc.), being operatively connected to said control port and to said effective output operator, for applying said sensed fluid pressure to said effective output operator.

39. A load responsive hydraulic system (FIG. 3 or FIG. 12,+FIG. 1 or FIG. 15) as claimed in claim 38 in which said second restricted flow path portion (168 of FIGS. 8 & 13C, or 303 of FIGS. 14E & 16) provides less restriction to fluid flow than said first restricted flow path portion (170 of FIGS. 8 & 13C, or 305 of FIGS. 14E & 16).

40. A load responsive hydraulic system (FIG. 3 or FIG. 12,+FIG. 1) as claimed in claim 38 in which said first (170 of FIGS. 8 & 13C) and fourth (169 of FIGS. 1 & 13C) restricted flow path portions comprise opposite directions of fluid flow in a first passage (134*a*), and said second (168) and third (171) restricted flow path portions comprise opposite directions of fluid flow in a second signal passage (134*b*).

41. A load responsive hydraulic system (FIG. 3 or FIG. 12,+FIG. 1) as claimed in claim 40 in which said restrictions of said first (170) and fourth (169) restricted flow path portions comprise a first flow restrictor (138*a*), and said restriction of said second (168) and third (171) restricted flow path portions comprise a second flow restrictor (138*b*).

42. A load responsive hydraulic system (FIG. 3 or FIG. 12,+FIG. 1) as claimed in claim 41 in which one of said passages (134*a* or 134*b*) includes a one-way flow and reverse flow restrictor valve (140*a* or 140*b*) therein; and said restriction of one (170 or 171) of said restricted flow path portions includes said one-way flow and reverse flow restrictor valve.

43. A load responsive hydraulic system (FIG. 3 or FIG. 12,+FIG. 1 or FIG. 15) of the type having a source (20 or 46) of pressurized fluid that includes a pump (22 or 48) and a sump (24*a* or 24*b*), having effective output means (26 or 60) that includes an effective output operator (28 or 56) for control of the pressure and effective output of said pump in response to a signal pressure applied to said effective output operator, having a fluid actuated device (156) that includes first (158*a*) and second (158*b*) actuating ports, and having a directional control valve (80 or 280) that includes a pressure inlet channel (92 or 296) connected to said source, that includes first (86*a* or 294*a*) and second (86*b* or 294*b*) work port channels operatively connected to respective ones of said actuating ports, that includes return port means (88 or 288) operatively connected to said sump, and that includes movable valving element means (94 or 284) for establishing both a first fluid flow path (162, or 344=346*a*+346*b*) from said pump to said first actuating port at the load actuating pressure of said device and a second fluid flow path (164 or 348) from said second actuating port to said return port means when said valving element means is moved to an operating position, and for occluding said first and second fluid flow paths when said valving element means is moved to a stand-by position, the improvement which comprises:

valved signal means (238), comprising first (258*a* or 258*b*) and second (308*a* or 308*b*) signal passages, comprising a one-way flow valve (204*a* or 206) in said second signal passage, and comprising a control port (130*g*) for establishing a first flow path portion (303 of FIG. 16, or 309 of FIG. 17) that communicates said pressure inlet channel to said control port after said second fluid flow path is established, for providing a second flow path portion (305 of FIG. 16, or 311 of FIG. 17) from said control port to said first work port channel through said one-way flow valve, for preventing fluid flow from said first work port channel to said control port through said second flow path portion, for providing a fluid restriction (210*a* of FIG. 16, or 210*b* or 318 of FIG. 17) in said first flow path portion, and for occluding said first flow path portion before said occlusion of said second fluid flow path; and means, being operatively connected to said control port and to said effective output operator, for communicating fluid pressure from said control port to said effective output operator.

44. A load responsive hydraulic system (FIG. 3 or FIG. 12, + FIG. 15) as claimed in claim 43 in which said one-way flow means comprises a check valve (206 of FIG. 17).

45. A load responsive hydraulic system (FIG. 3 or FIG. 12, + FIG. 15) as claimed in claim 43 in which said one-way flow means comprises a relief valve (204*a* of FIG. 16).

46. A load responsive hydraulic system (FIG. 3 or FIG. 12, + FIG. 15) as claimed in claim 43 in which said valved signal means (238) includes second fluid restriction means (204*a* or 222) for providing a predetermined resistance to fluid flow from said control port (130*g*) to said first work port channel (294*a* or 294*b*).

47. A load responsive hydraulic system (FIG. 3 or FIG. 12, + FIG. 15) as claimed in claim 46 in which said second fluid restriction means comprises a fixed conductance restrictor (222).

48. A load responsive hydraulic system (FIG. 3 or FIG. 12, + FIG. 15) as claimed in claim 46 in which both said second fluid restriction means and said one-way flow means comprise a resiliently biased restrictor (204*a*).

49. A load responsive hydraulic system (FIG. 3 or FIG. 12, + FIG. 1 or FIG. 15) of the type having a source (20 or 46) of pressurized fluid that includes a pump (22 or 48) and a sump (24*a* or 24*b*), having effective output means (26 or 60) that includes an effective output operator (28 or 56) for control of the pressure and effective output of said pump in response to a signal pressure applied to said effective output operator, having a fluid actuated device (156) that includes first (158*a*) and second (158*b*) actuating ports, and having a directional control valve (80 or 280) that includes a pressure inlet channel (92 or 296) connected to said source, that includes first (86*a* or 294*a*) and second (86*b* or 294*b*) work port channels operatively connected to respective ones of said actuating ports, that includes return port means (88 or 288) operatively connected to said sump, and that includes movable valving element means (94 of 284) for establishing both a first fluid flow path (162, or 344=346*a*+346*b*) from said pump to said first actuating port at the load actuating pressure of said device and a second fluid flow path (164 or 348) from said second actuating port to said return port means when said valving element means is moved to a first operating position, for establishing both a third fluid flow path from said pump to said second actuating port and a fourth fluid flow path from said first actuating port to said return port means when said valving element means is moved to a second operating position, and for occluding all of said fluid flow paths when said valving element means is moved to a standby position, the improvement which comprises:

valved signal means (238), comprising a logic valve (256) that includes an unvalved logic port (271), that includes first (270*a*) and second (270*b*) valved logic ports, and that includes a shuttle (268), comprising a control port (130*g*) that is connected to said unvalved logic port, comprising a first signal passage (308*a*) that interconnects said first valved logic port and said first work port channel, comprising a first one-way flow valve (204*a*) that is interposed into said first signal passage, comprising a second signal passage (308*b*) that interconnects said second valved logic port and said second work port channel, and comprising a second one-way flow valve (206) that is interposed into said second signal passage, for establishing a first restricted flow path portion (303 of FIG. 16) that communicates said pressure inlet channel to said control port after said second fluid flow path has been established, for establishing a first one-way flow path portion (305 of FIG. 16) from said first restricted flow path portion to said first work port channel, for occluding said first restricted flow path portion before said occluding of said second fluid flow path, for establishing a second restricted flow path portion (309 of FIG. 17) that communicates said pressure inlet channel to said control port after said fourth fluid flow path has been established, for establishing a second one-way flow path portion (311 of FIG. 17) from said second restricted flow path portion to said second work port channel, and for occluding said second restricted flow path portion before said occluding of said fourth fluid flow path; and means (36), being operatively connected to said control port and to said effective output operator, for communicating fluid pressure from said control port to said effective output operator.

50. A load responsive hydraulic system (FIG. 3 or FIG. 12, + FIG. 15) as claimed in claim 49 in which said directional control valve (280) includes a body (282) having a spool bore (286);

said pressure inlet channel (296), said return port means (290+292*a*+292*b*) and one (294*b*) of said work port channels intercept said spool bore in spaced-apart locations;

said movable valving element means comprises a valve spool (284) having three land portions (312*a*, 312*b*, and 213*c*) that are spaced-apart by respective ones of two (314*a* or 314*b*) reduced cross-section portions; and said valved signal means and said establishing of one of said restricted flow path portions (303 of FIG. 16, or 309 of FIG. 17) thereof comprises one of said signal passages (258*a* or 258*b*) intercepting said spool bore.

51. A load responsive hydraulic system (FIG. 3 or FIG. 12, + FIG. 15) as claimed in claim 50 in which said intercepting means comprises an elongated circumferential groove (298) that divides said spool bore (286) into a first bore portion (350) that is intermediate of said pressure inlet channel (296) and said circumferential groove (298), and a second bore portion (351) that is proximal to said circumferential groove and distal from said pressure inlet channel;

said circumferential groove has a longer length than that of said second land portion; and said establishing of said first fluid flow path (344=346*a*+346*b*) comprises positioning the center one (312*b*) of said three land portions within said elongated circumferential groove when said valve spool is in said operating position (FIG. 16), and communicating said pressure inlet channel with said second bore portion by said second (314*b*) and first (314*a*) reduced cross-section portions.

52. A load responsive hydraulic system (FIG. 3 or FIG. 12, + FIG. 15) as claimed in claim 51 in which said valved signal means (238) comprises longitudinally disposed hole means (328=330+332+334) in said valve spool for establishing an attenuation flow path (299) from said elongated circumferential groove (298) to said return port means (288=290+292*a*+292*b*) when said movable valving element (284) is in said stand-by position (FIG. 15) and for occluding said attenuation flow path before said first (344=346*a*+346*b*) fluid flow path is established.

53. A load responsive hydraulic system (FIG. 3 or FIG. 12, + FIG. 15) as claimed in claim 50 in which said valved signal means (238) and said communicating of said second restricted flow path portion (309 of FIG. 17) thereof to said control port (130*g*) comprises connecting said second restricted flow path portion to said unvalved logic port (271 via chamber 274) of said logic valve (256).

54. A load responsive hydraulic system (FIG. 3 or FIG. 12, + FIG. 15) as claimed in claim 53 in which said logic valve (256) includes a shuttle (268), and means (272) for resiliently urging said shuttle into flow occluding engagement with one (270*a*) of said valved logic ports.

* * * * *